US012158270B2

(12) United States Patent
Vukanti et al.

(10) Patent No.: US 12,158,270 B2
(45) Date of Patent: Dec. 3, 2024

(54) GAS TURBINE ENGINE COMBUSTOR WITH A SET OF DILUTION PASSAGES

(71) Applicant: General Electric Company, Schenectady, NY (US)

(72) Inventors: Perumallu Vukanti, Bengaluru (IN); Pradeep Naik, Bengaluru (IN); R Narasimha Chiranthan, Bengaluru (IN); Ajoy Patra, Bengaluru (IN); Arijit Sinha Roy, Bangalore (IN); Pabitra Badhuk, Bengaluru (IN); Aritra Chakraborty, Bengaluru (IN); Bhavya Naidu Panduri, Bengaluru (IN); Michael T. Bucaro, Arvada, CO (US); Sibtosh Pal, Mason, OH (US)

(73) Assignee: General Electric Company, Evendale, OH (US)

( * ) Notice: Subject to any disclaimer, the term of this patent is extended or adjusted under 35 U.S.C. 154(b) by 0 days.

(21) Appl. No.: 18/104,408

(22) Filed: Feb. 1, 2023

(65) Prior Publication Data

US 2024/0200778 A1 Jun. 20, 2024

(30) Foreign Application Priority Data

Dec. 20, 2022 (IN) ..... 202211073867

(51) Int. Cl.

| | |
|---|---|
| ***F23R 3/46*** | (2006.01) |
| ***F23R 3/04*** | (2006.01) |
| ***F23R 3/18*** | (2006.01) |

(52) U.S. Cl.
CPC ..... *F23R 3/18* (2013.01); *F23R 3/04* (2013.01); *F23R 3/46* (2013.01)

(58) Field of Classification Search
CPC ..... F23R 3/04; F23R 3/06; F23R 3/10; F23R 3/50; F23R 2900/03041; F23R 2900/03043
See application file for complete search history.

(56) References Cited

U.S. PATENT DOCUMENTS

| | | | | |
|---|---|---|---|---|
| 2,545,495 A | | 3/1951 | Sforzini | |
| 3,077,073 A | | 2/1963 | Kuhrt | |
| 4,062,182 A | | 12/1977 | Fehler et al. | |
| 4,085,581 A | * | 4/1978 | Caruel | F23R 3/002 60/738 |
| 4,241,586 A | * | 12/1980 | Caruel | F23R 3/002 60/738 |
| 4,262,486 A | | 4/1981 | Russell | |

(Continued)

FOREIGN PATENT DOCUMENTS

| | | |
|---|---|---|
| CA | 2939125 A1 | 3/2017 |
| EP | 2206964 A3 | 5/2012 |

(Continued)

*Primary Examiner* — Alain Chau
(74) *Attorney, Agent, or Firm* — McGarry Bair PC

(57) ABSTRACT

A combustor comprising a dome wall, an annular liner, a combustion chamber, a set of fuel cups, and a set of dilution passages for each fuel cup of the set of fuel cups. The set of fuel cups circumferentially spaced along the dome wall relative to the combustor centerline. The set of dilution passages terminating in a plurality of slots spaced about the corresponding fuel cup in the set of fuel cups.

19 Claims, 16 Drawing Sheets

(56) References Cited

U.S. PATENT DOCUMENTS

| | | | | |
|---|---|---|---|---|
| 5,253,471 | A * | 10/1993 | Richardson | F23R 3/002 60/754 |
| 5,331,805 | A * | 7/1994 | Myers | F23R 3/14 60/804 |
| 6,148,604 | A | 11/2000 | Salt et al. | |
| 7,124,588 | B2 * | 10/2006 | Gerendas | F23R 3/06 60/754 |
| 7,389,643 | B2 | 6/2008 | Simons et al. | |
| 7,546,737 | B2 | 6/2009 | Schumacher et al. | |
| 7,681,398 | B2 | 3/2010 | Patel et al. | |
| 8,109,099 | B2 | 2/2012 | Tu et al. | |
| 8,365,536 | B2 | 2/2013 | Khan et al. | |
| 8,387,397 | B2 | 3/2013 | Chen et al. | |
| 8,424,311 | B2 | 4/2013 | York et al. | |
| 8,590,312 | B2 | 11/2013 | Sandelis | |
| 8,607,572 | B2 | 12/2013 | Koizumi et al. | |
| 9,103,547 | B2 | 8/2015 | Eroglu et al. | |
| 9,534,790 | B2 | 1/2017 | Cai et al. | |
| 9,557,060 | B2 | 1/2017 | Papple et al. | |
| 9,840,924 | B2 | 12/2017 | Hase et al. | |
| 9,976,743 | B2 | 5/2018 | Propheter-Hinckley et al. | |
| 10,072,846 | B2 | 9/2018 | Monahan et al. | |
| 10,088,159 | B2 | 10/2018 | Erbas-Sen et al. | |
| 10,107,496 | B2 * | 10/2018 | Rathmann | F23R 3/50 |
| 10,132,500 | B2 | 11/2018 | Ryon et al. | |
| 10,208,958 | B2 | 2/2019 | Carroni et al. | |
| 10,408,453 | B2 | 9/2019 | Mongillo et al. | |
| 10,408,457 | B2 | 9/2019 | Akiyama et al. | |
| 10,648,666 | B2 | 5/2020 | Bouldin et al. | |
| 10,731,861 | B2 | 8/2020 | Schlein | |
| 10,844,791 | B2 | 11/2020 | Olsen et al. | |
| 10,859,271 | B2 * | 12/2020 | Rimmer | F23R 3/002 |
| 11,029,027 | B2 | 6/2021 | Lewis et al. | |
| 11,073,284 | B2 | 7/2021 | Sandoval | |
| 2003/0182943 | A1 * | 10/2003 | Gerendas | F23R 3/06 60/754 |
| 2007/0056289 | A1 * | 3/2007 | Sandelis | F23R 3/002 60/752 |
| 2008/0060360 | A1 * | 3/2008 | Stastny | F23R 3/10 60/752 |
| 2008/0104962 | A1 * | 5/2008 | Patel | F01D 25/12 60/752 |
| 2008/0115498 | A1 * | 5/2008 | Patel | F23R 3/10 60/752 |
| 2008/0115499 | A1 * | 5/2008 | Patel | F23R 3/10 60/752 |
| 2008/0178599 | A1 * | 7/2008 | Hawie | F23R 3/50 60/752 |
| 2009/0188256 | A1 | 7/2009 | Woodcock et al. | |
| 2011/0056205 | A1 | 3/2011 | Carroni et al. | |
| 2013/0042627 | A1 * | 2/2013 | Gerendas | F23M 20/005 60/725 |
| 2015/0330635 | A1 | 11/2015 | Pidcock et al. | |
| 2016/0091206 | A1 * | 3/2016 | Rathmann | F23R 3/60 60/752 |
| 2016/0201918 | A1 | 7/2016 | Jella et al. | |
| 2017/0191664 | A1 * | 7/2017 | Bennett | F23R 3/10 |
| 2019/0113235 | A1 | 4/2019 | Johnson et al. | |
| 2019/0162414 | A1 | 5/2019 | Ogata et al. | |
| 2019/0249875 | A1 | 8/2019 | Gandikota | |
| 2021/0247069 | A1 | 8/2021 | Iwai et al. | |
| 2021/0396388 | A1 | 12/2021 | Mongillo, Jr. et al. | |

FOREIGN PATENT DOCUMENTS

| | | | |
|---|---|---|---|
| EP | 2685170 | A1 | 1/2014 |
| EP | 2902708 | B1 | 2/2017 |
| EP | 2407720 | B1 | 10/2019 |
| EP | 2959229 | B1 | 10/2020 |
| EP | 3431875 | B1 | 12/2020 |
| EP | 4209714 | A1 | 7/2023 |
| GB | 2429516 | B | 12/2010 |
| GB | 2581385 | B1 | 8/2020 |

* cited by examiner

200

GAS TURBINE ENGINE COMBUSTOR WITH A SET OF DILUTION PASSAGES

CROSS-REFERENCE TO RELATED APPLICATION(S)

This application claims priority to Indian Patent Application No. 202211073867, filed Dec. 20, 2022, which is incorporated herein by reference its entirety.

TECHNICAL FIELD

The present subject matter relates generally to a gas turbine engine combustor with a set of dilution passages, more specifically to a combustor having a set of dilution passages located in a dome wall.

BACKGROUND

Gas turbine engines are driven by a flow of combustion gases passing through the engine to rotate a multitude of turbine blades. A combustor can be provided within the gas turbine engine and is fluidly coupled with a turbine into which the combusted gases flow.

Hydrocarbon fuels are commonly used in the combustor of a gas turbine engine. Generally, air and fuel are fed separately to the combustor, until they are mixed, and the mixture is combusted to produce hot combustion gas. The combustion gas is then fed to a turbine where it rotates the turbine to produce power. By-products of the hydrocarbon fuel combustion typically include nitrogen oxide and nitrogen dioxide (collectively called NOx), carbon monoxide (CO), unburned hydrocarbon (UHC) (e.g., methane and volatile organic compounds that contribute to the formation of atmospheric ozone), and other oxides, including oxides of sulfur (e.g., $SO_2$ and $SO_3$).

DETAILED DESCRIPTION

Figure 1:
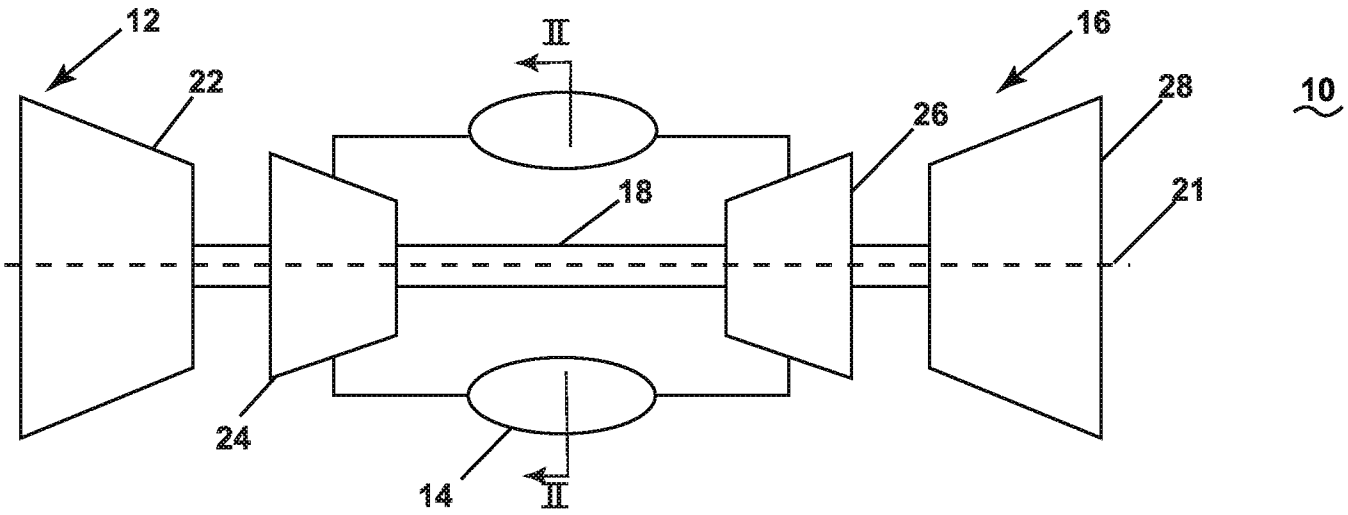
FIG. 1 is a schematic of a gas turbine engine.

Aspects of the disclosure described herein are directed to a combustor. The combustor includes a combustion chamber at least partially defined by a dome wall. A set of fuel cups are annularly arranged on the dome wall and fluidly coupled to the combustion chamber. A dilution passage arrangement is provided around each fuel cup of the set of fuel cups. The dilution passage arrangement of each fuel cup can be selected to function with adjacent fuel cups and their corresponding dilution passage arranged to collectively control the annular flame spread from all of the fuel cups as well as individually controlling the flame spread from each fuel cup. Each dilution passage arrangement includes a set of dilution passages terminating in a plurality of slots provided along the dome wall. As described herein, a single "dilution passage arrangement" refers to a plurality of slots provided around a single, corresponding fuel cup of the set of fuel cups. It will be appreciated that there can be any number of dilution passage arrangements. For example, the total number of dilution passage arrangements can correspond to the total number of fuel cups of the set of fuel cups.

For purposes of illustration, the present disclosure will be described with respect to a gas turbine engine. It will be understood, however, that aspects of the disclosure described herein are not so limited and that a combustor as described herein can be implemented in engines, including but not limited to turbojet, turboprop, turboshaft, and turbofan engines. Aspects of the disclosure discussed herein may have general applicability within non-aircraft engines having a combustor, such as other mobile applications and non-mobile industrial, commercial, and residential applications.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

As used herein, the terms "first", "second", and "third" may be used interchangeably to distinguish one component from another and are not intended to signify location or importance of the individual components.

The terms "forward" and "aft" refer to relative positions within a gas turbine engine or vehicle, and refer to the normal operational attitude of the gas turbine engine or vehicle. For example, with regard to a gas turbine engine, forward refers to a position closer to an engine inlet and aft refers to a position closer to an engine nozzle or exhaust.

As used herein, the term "upstream" refers to a direction that is opposite the fluid flow direction, and the term "downstream" refers to a direction that is in the same direction as the fluid flow. The term "fore" or "forward" means in front of something and "aft" or "rearward" means behind something. For example, when used in terms of fluid flow, fore/forward can mean upstream and aft/rearward can mean downstream.

The term "fluid" may be a gas or a liquid. The term "fluid communication" means that a fluid is capable of making the connection between the areas specified.

Additionally, as used herein, the terms "radial" or "radially" refer to a direction away from a common center. For example, in the overall context of a gas turbine engine, radial refers to a direction along a ray extending between a center longitudinal axis of the engine and an outer engine circumference.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate structural elements between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

The singular forms "a", "an", and "the" include plural references unless the context clearly dictates otherwise. Furthermore, as used herein, the term "set" or a "set" of elements can be any number of elements, including only one.

Approximating language, as used herein throughout the specification and claims, is applied to modify any quantitative representation that could permissibly vary without resulting in a change in the basic function to which it is related. Accordingly, a value modified by a term or terms, such as "about", "approximately", "generally", and "substantially", are not to be limited to the precise value specified. In at least some instances, the approximating language may correspond to the precision of an instrument for measuring the value, or the precision of the methods or machines for constructing or manufacturing the components and/or systems. In at least some instances, the approximating language may correspond to the precision of an instrument for measuring the value, or the precision of the methods or machines for constructing or manufacturing the components and/or systems. For example, the approximating language may refer to being within a 1, 2, 4, 5, 10, 15, or 20 percent margin in either individual values, range(s) of values and/or endpoints defining range(s) of values. Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

FIG. 1 is a schematic view of a gas turbine engine 10. As a non-limiting example, the gas turbine engine 10 can be used within an aircraft. The gas turbine engine 10 can include, at least, a compressor section 12, a combustion section 14, and a turbine section 16 in serial flow arrangement. A drive shaft 18 rotationally couples the compressor and turbine sections 12, 16, such that rotation of one affects the rotation of the other, and defines a rotational axis or engine centerline 21 for the gas turbine engine 10.

The compressor section 12 can include a low-pressure (LP) compressor 22, and a high-pressure (HP) compressor 24 serially fluidly coupled to one another. The turbine section 16 can include an LP turbine 26, and an HP turbine 28 serially fluidly coupled to one another. The drive shaft 18 can operatively couple the LP compressor 22, the HP compressor 24, the LP turbine 26 and the HP turbine 28 together. Alternatively, the drive shaft 18 can include an LP drive shaft (not illustrated) and an HP drive shaft (not illustrated). The LP drive shaft can couple the LP compressor 22 to the LP turbine 26, and the HP drive shaft can couple the HP compressor 24 to the HP turbine 28. An LP spool can be defined as the combination of the LP compressor 22, the LP turbine 26, and the LP drive shaft such that the rotation of the LP turbine 26 can apply a driving force to the LP drive shaft, which in turn can rotate the LP compressor 22. An HP spool can be defined as the combination of the HP compressor 24, the HP turbine 28, and the HP drive shaft such that the rotation of the HP turbine 28 can apply a driving force to the HP drive shaft which in turn can rotate the HP compressor 24.

The compressor section 12 can include a plurality of axially spaced stages. Each stage includes a set of circumferentially-spaced rotating blades and a set of circumferentially-spaced stationary vanes. The compressor blades for a stage of the compressor section 12 can be mounted to a disk, which is mounted to the drive shaft 18. Each set of blades for a given stage can have its own disk. The vanes of the compressor section 12 can be mounted to a casing which can extend circumferentially about the gas turbine engine 10. It will be appreciated that the representation of the compressor section 12 is merely schematic and that there can be any number of stages. Further, it is contemplated, that there can be any other number of components within the compressor section 12.

Similar to the compressor section 12, the turbine section 16 can include a plurality of axially spaced stages, with each stage having a set of circumferentially-spaced, rotating blades and a set of circumferentially-spaced, stationary vanes. The turbine blades for a stage of the turbine section 16 can be mounted to a disk which is mounted to the drive shaft 18. Each set of blades for a given stage can have its own disk. The vanes of the turbine section can be mounted to the casing in a circumferential manner. It is noted that there can be any number of blades, vanes and turbine stages as the illustrated turbine section is merely a schematic representation. Further, it is contemplated, that there can be any other number of components within the turbine section 16.

The combustion section 14 can be provided serially between the compressor section 12 and the turbine section 16. The combustion section 14 can be fluidly coupled to at least a portion of the compressor section 12 and the turbine section 16 such that the combustion section 14 at least partially fluidly couples the compressor section 12 to the turbine section 16. As a non-limiting example, the combustion section 14 can be fluidly coupled to the HP compressor 24 at an upstream end of the combustion section 14 and to the HP turbine 28 at a downstream end of the combustion section 14.

During operation of the gas turbine engine 10, ambient or atmospheric air is drawn into the compressor section 12 via a fan (not illustrated) upstream of the compressor section 12, where the air is compressed defining a pressurized air. The pressurized air can then flow into the combustion section 14 where the pressurized air is mixed with fuel and ignited, thereby generating combustion gases. Some work is extracted from these combustion gases by the HP turbine 28, which drives the HP compressor 24. The combustion gases are discharged into the LP turbine 26, which extracts additional work to drive the LP compressor 22, and the exhaust gas is ultimately discharged from the gas turbine engine 10 via an exhaust section (not illustrated) downstream of the turbine section 16. The driving of the LP turbine 26 drives the LP spool to rotate the fan (not illustrated) and the LP compressor 22. The pressurized airflow and the combustion gases can together define a working airflow that flows through the fan, compressor section 12, combustion section 14, and turbine section 16 of the gas turbine engine 10.

Figure 2:
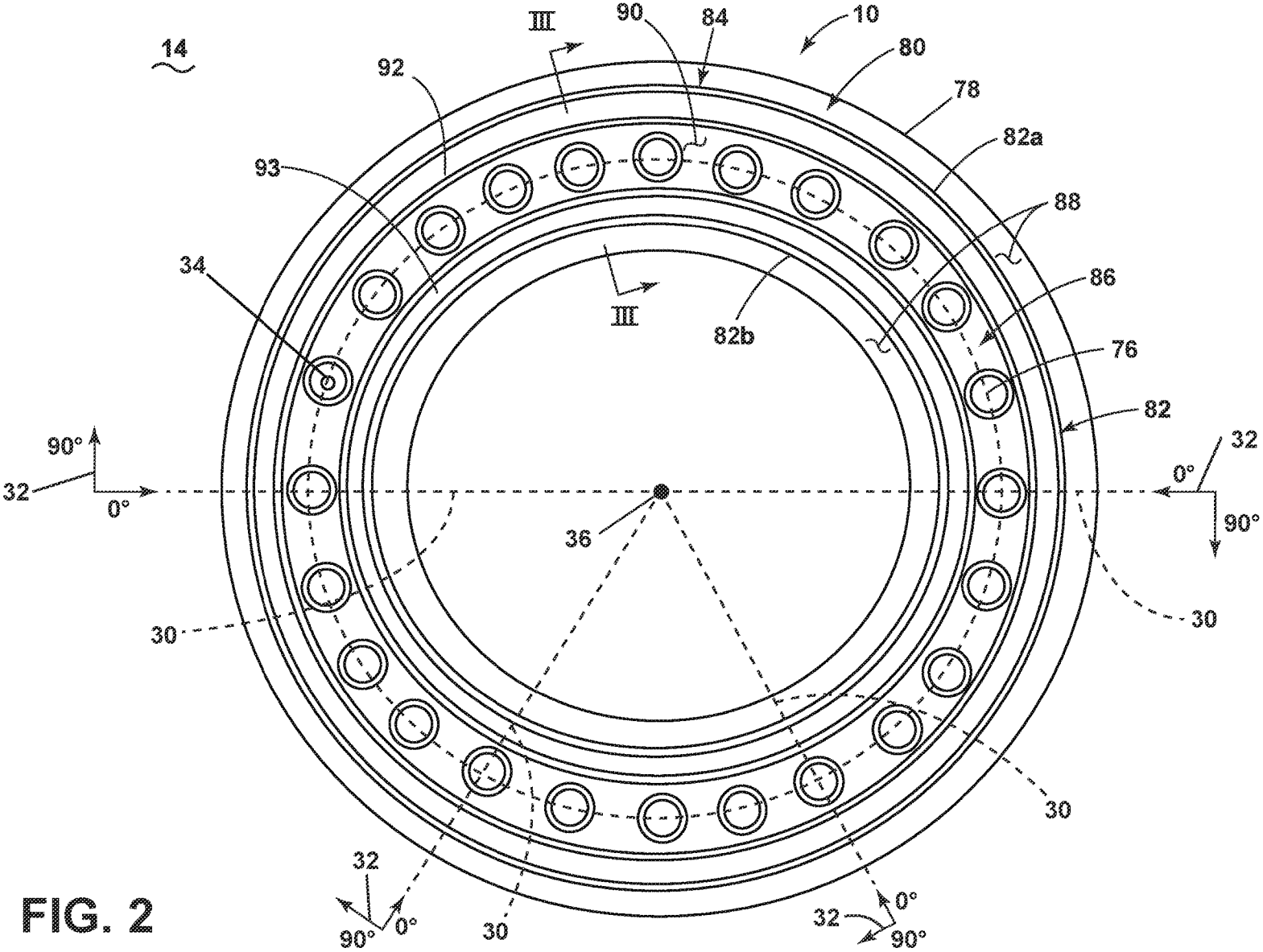
FIG. 2 depicts a cross-section view along line II-II of FIG. 1 of a combustion section of the gas turbine engine.

FIG. 2 depicts a cross-section view of the combustion section 14 along line II-II of FIG. 1. The combustion section 14 can include an set of fuel cups 76 disposed around a combustor centerline 36. The combustor centerline 29 can be the centerline 21 of the turbine engine 10. The combustor centerline 36 can be a centerline for the combustion section 14, a single combustor, or a set of combustors that are arranged about the combustor centerline 36.

The combustor 80 can have a can, can-annular, or annular arrangement depending on the type of engine in which the combustor 80 is located. In a non-limiting example, an annular arrangement is illustrated and disposed within a casing 78. The combustor 80 is defined by a combustor liner 82 including an outer annular combustor liner 82*a* and an inner annular combustor liner 82*b* concentric with respect to each other and annular about the combustor centerline 36. A dome assembly 84 including a dome wall 90 together with the combustor liner 82 can define a combustion chamber 86 annular about the combustor centerline 36. At least one fuel cup 76, illustrated as multiple fuel injectors annularly arranged about the combustor centerline 36, is fluidly coupled to the combustion chamber 86. A compressed air passageway 88 can be defined at least in part by both the combustor liner 82 and the casing 78.

The at least one fuel cup 76 is included within a plurality of fuel cups 76. Each fuel cup 76 can include a fuel cup centerline 34 that extends into the page. Each fuel cup centerline 34 can be arranged along a circumferential line 70. Alternatively, one or more fuel cups 76 can be offset from the circumferential line 70. Additionally, the fuel cups 76 can be arranged such that the fuel cup centerlines 34 form a pattern relative to, but not necessarily on, the circumferential line 70.

Each fuel cup centerline 34 in combination with the combustor centerline 36, can be used to define a respective fuel cup reference line 30 that extends radially from the combustor centerline 36 and through the corresponding fuel cup centerline 34. For the purposes of illustration, four fuel cup reference lines 30 are shown, however, it will be appreciated that each fuel cup 76 includes a fuel cup reference line 30. The fuel cup reference line 30 is used in this description to establish a local polar coordinate system 32 for each fuel cup 76. The local polar coordinate system defines a 0-180 degree line lying on the corresponding reference line 30, and a 90-270 degree line for each of the four illustrated fuel cup reference lines 30. The 0 degree and 90 degree lines have been shown for convenience on each of the polar coordinate systems 32. Since the fuel cups 76 are circumferentially spaced around the combustor centerline 36, a polar coordinate system based on the fuel cup reference line 30 is a convenient way to describe the local fuel cups 76, while taking into account the rotational shifts in the local coordinate system due to the circumferential arrangement.

Figure 3:
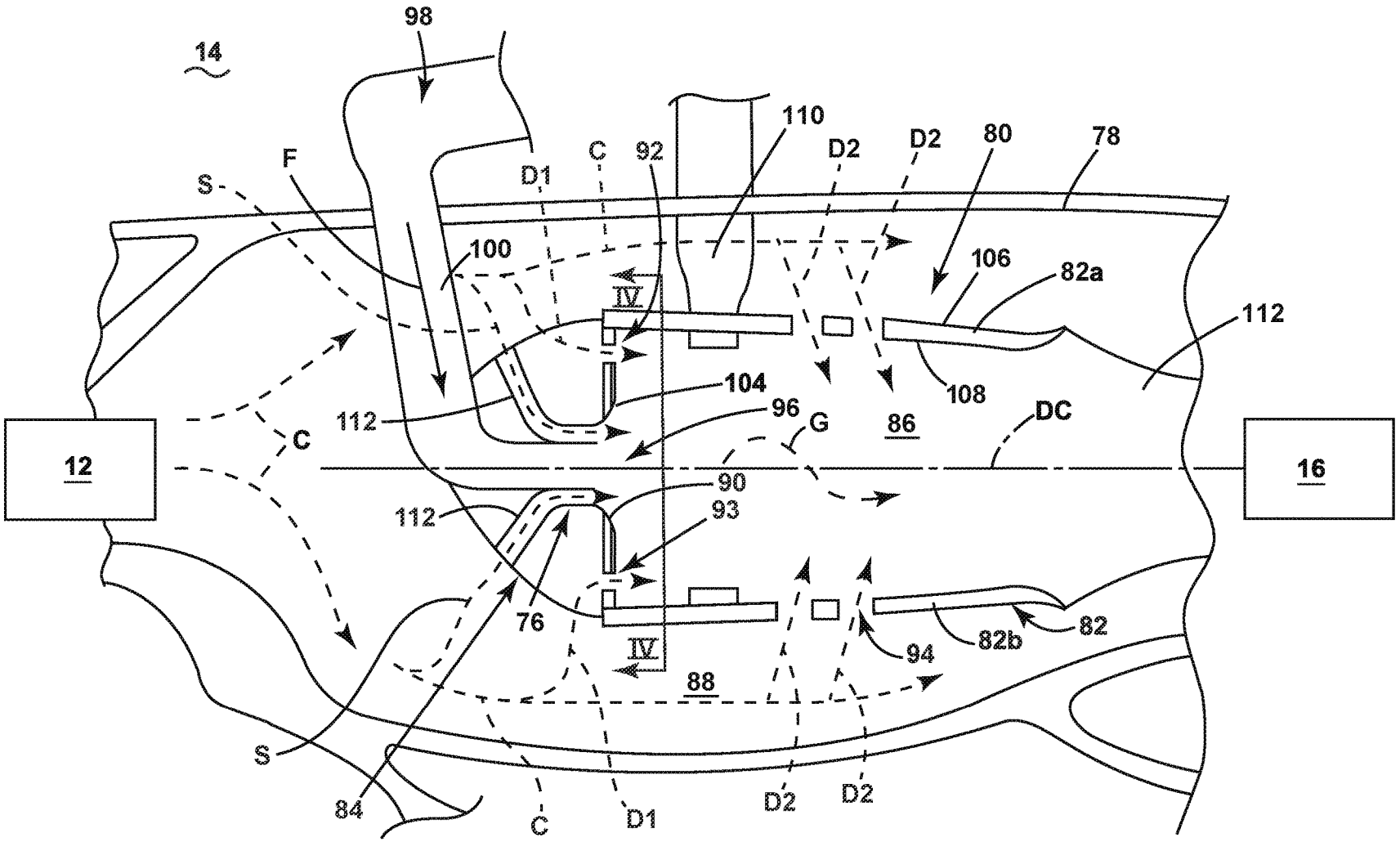
FIG. 3 is a schematic of a side cross-sectional view taken along line III-III of FIG. 2 of a combustor in the combustion section formed from a combustor liner having multiple sets of dilution passages according to an aspect of the disclosure herein.

FIG. 3 depicts a cross-section view taken along line III-III of FIG. 2 illustrating the combustion section 14. A first set of dilution passages 92, a second set of dilution passages 93 and a third set of dilution passages 94 can fluidly connect the compressed air passageway 88 and the combustor 80.

The fuel cup 76 can be coupled to and disposed within the dome assembly 84. The fuel cup 76 can include a flare cone 104 and a swirler 112. The flare cone 104 includes an outlet 96 of the fuel cup 76 directly fluidly coupled to the combustion chamber 86. The fuel cup 76 is fluidly coupled to a fuel inlet 98 via a linear passageway 100.

Both the inner and outer combustor liners 82*a*, 82*b* can have an outer surface 106 and an inner surface 108 at least partially defining the combustion chamber 86. The combustor liner 82 can be made of one continuous monolithic portion or be multiple monolithic portions assembled together to define the inner and outer combustor liners 82*a*, 82*b*. By way of non-limiting example, the outer surface 106 can define a first piece of the combustor liner 82 while the inner surface 108 can define a second piece of the combustor liner 82 that when assembled together form the combustor liner 82. As described herein, the combustor liner 82 includes the third set of dilution passages 94. It is further contemplated that the combustor liner 82 can be any type of combustor liner 82, including but not limited to a single wall or a double walled liner or a tile liner. An ignitor 110 can be provided at the combustor liner 82 and fluidly coupled to the combustion chamber 86, at any location, by way of non-limiting example upstream of the third set of dilution passages 94.

During operation, a compressed air (C) can flow from the compressor section 12 to the combustor 80 through the dome assembly 84. The compressed air (C) is fed to the fuel cup 76 via the swirler 112 as a swirled airflow (S). A flow of fuel (F) is fed to the fuel cup 76 via the fuel inlet 98 and the linear passageway 100. The swirled airflow (S) and the flow of fuel (F) are mixed at the flare cone 104 and fed to the combustion chamber 86 as a fuel/air mixture. The ignitor 110 can ignite the fuel/air mixture to define a flame within the combustion chamber 86, which generates a combustion gas (G). While shown as starting axially downstream of the outlet 96, it will be appreciated that the fuel/air mixture can be ignited at or near the outlet 96.

The compressed air (C) is further fed to dilution passages 92, 93 as a first dilution airflow (D1) and to the third set of dilution passages 94 as a second dilution airflow (D2). The first dilution airflow (D1) is used to direct and shape the flame, while the second dilution airflow (D2) is used to direct the combustion gas (G).

The combustor 80 shown in FIG. 3 is well suited for the use of a hydrogen-containing gas as the fuel because it helps contain the faster moving flame front associated with hydrogen fuel, as compared to traditional hydrocarbon fuels. However, the combustor 80 can be used with traditional hydrocarbon fuels.

Figure 4:
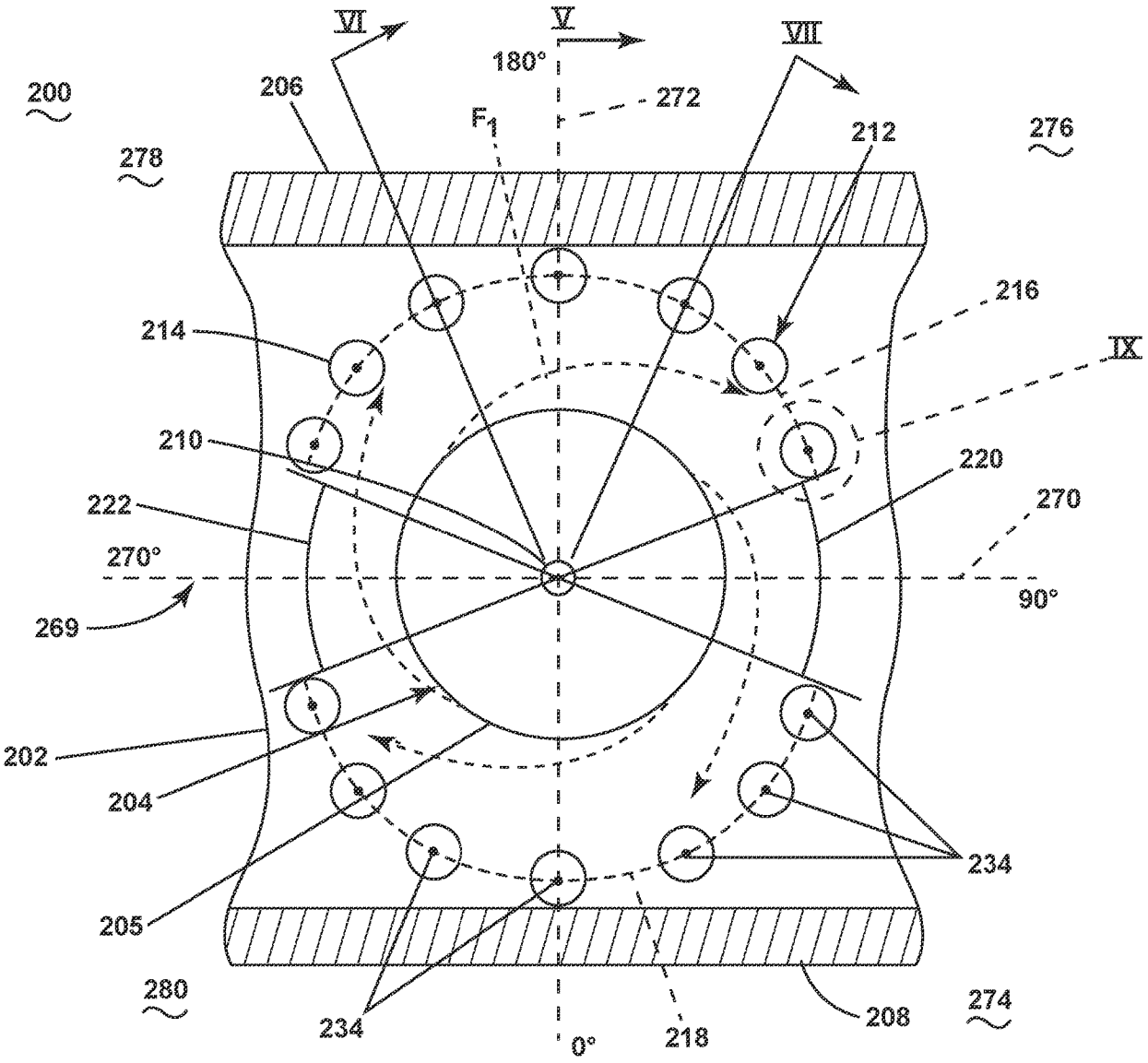
FIG. 4 is a schematic, transverse cross-sectional view of a first dilution passage arrangement provided on a dome wall suitable for use within the combustor of FIG. 3.

FIG. 4 is a schematic, transverse, cross-sectional view of a first dilution passage arrangement 200 on a dome wall 202 suitable for use within the combustor 80 of FIG. 3. Therefore, similar parts of the first dilution passage arrangement 200 and the combustor 80 will be given similar names, with it being understood that the description of similar parts of the combustor 80 applies to the first dilution passage arrangement 200, unless indicated otherwise. The first dilution passage arrangement 200 is provided on the dome wall 202 around a fuel cup 204 having a fuel cup centerline 210 and an outlet 205. The dome wall 202 extends between an outer liner 206 and an inner liner 208.

A plurality of dilution passages 212 extend through the dome wall 202 and include a plurality of slots 214. Each slot of the plurality of slots 214 defines a termination point of one or more dilution passages 212 of the plurality of dilution passages 212. Each dilution passage 212 extends along a passage centerline 234 that terminates at a respective slot 214 to define a center point (indicated by the passage centerline 234 on each dilution on each slot 214) of the respective slot 214. The plurality of slots 214 are circumferentially spaced about at least a portion of the fuel cup centerline 210. As a non-limiting example, a single dilution passage 212 terminates in a single slot 214. However, a dilution passage can have multiple branches, with each branch terminating in a slot. Each slot of the plurality of slots 214 is defined by a cross-sectional area when viewed along a vertical plane extending perpendicularly to the fuel cup centerline 210 and intersecting the slot 214. The cross-sectional area can be any suitable shape such as, but not limited to, obround, ovate, oblong, round, elongated, rectangular, triangular, or the like. Further, the cross-sectional area can be uniform or non-uniform amongst the plurality of slots 214 such that one or more of the slots can be larger or include a different shape than another slot.

At least a portion of the plurality of slots 214 are arranged such that the passage centerline 234 is provided along a first line 216. Another portion of the plurality of slots 214 are arranged such that their passage centerlines 234 are provided along a second line 218. As illustrated, the first line 216 and the second line 218 are arcs centered on the fuel cup centerline 210. Some of these additional paths are illustrated in the different arrangements shown in FIGS. 10-16.

The first dilution passage arrangement 200 can be positioned about the fuel cup 204 with respect to a polar coordinate system 269. The polar coordinate system 269 includes a 0 degree to 180 degree line defining a fuel cup reference line 272, and a 90 degree to 270 degree line defining a transverse reference line 270. The polar coordinate system 269 can be divided into four quadrants: a first quadrant 274 between 0-90 degrees, a second quadrant 276 between 90-180 degrees, a third quadrant 278 between 180-270 degrees and a fourth quadrant 280 between 270 to 360 degrees.

The first line 216 and the second line 218 each define arc segments extending circumferentially around at least a portion of the fuel cup centerline 210. These arc segments are defined as slot-present arc segments. A first break 220 and a second break 222 are formed circumferentially between the first line 216 and the second line 218. The first break 220 and the second break 222 define opposing slot-free arc segments. The first break 220 is provided within +/−75 degrees of the transverse reference line 270. The second break 222 is provided within +/−75 degrees of the transverse reference line 270.

The first line 216 and the second line 218, and thus the plurality of slots 214, can extend across or within any suitable portion of the polar coordinate system 269. As a non-limiting example, the first line 216 or the second line 218, and thus the plurality of slots 214, can extend between at least two adjacent quadrants.

The first dilution passage arrangement 200 is symmetrical or non-symmetrical about at least one of the transverse reference line 270 or the fuel cup reference line 272.

During operation, a fuel/air mixture (F1) is supplied through the outlet 205 of the fuel cup 204. The fuel/air mixture (F1) can exit the fuel cup 204 in a straight line or otherwise include a circumferential swirl, thus defining the fuel/air mixture (F1) as a swirled fuel/air mixture. When swirled, the fuel/air mixture (F1) includes a circumferential component, with respect to the fuel cup centerline 210. The plurality of slots 214 circumscribe at least a portion of the fuel air mixture (F1).

Figure 5:
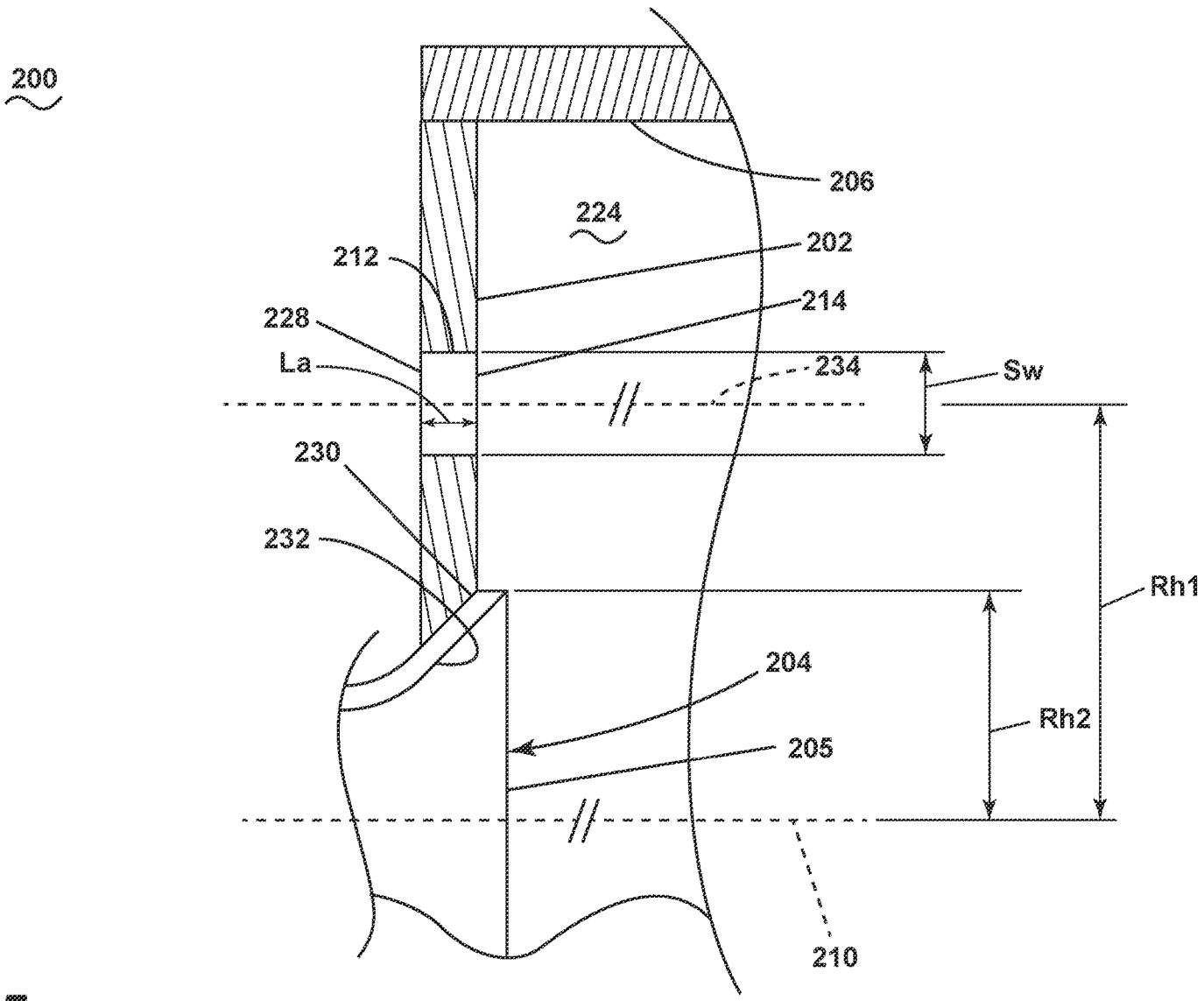
FIG. 5 is a partial side cross-sectional view of a portion of the first dilution passage arrangement of FIG. 4 as seen from line V of FIG. 4, illustrating a first passage angle defining a first orientation for the dilution passage.
Figure 6:
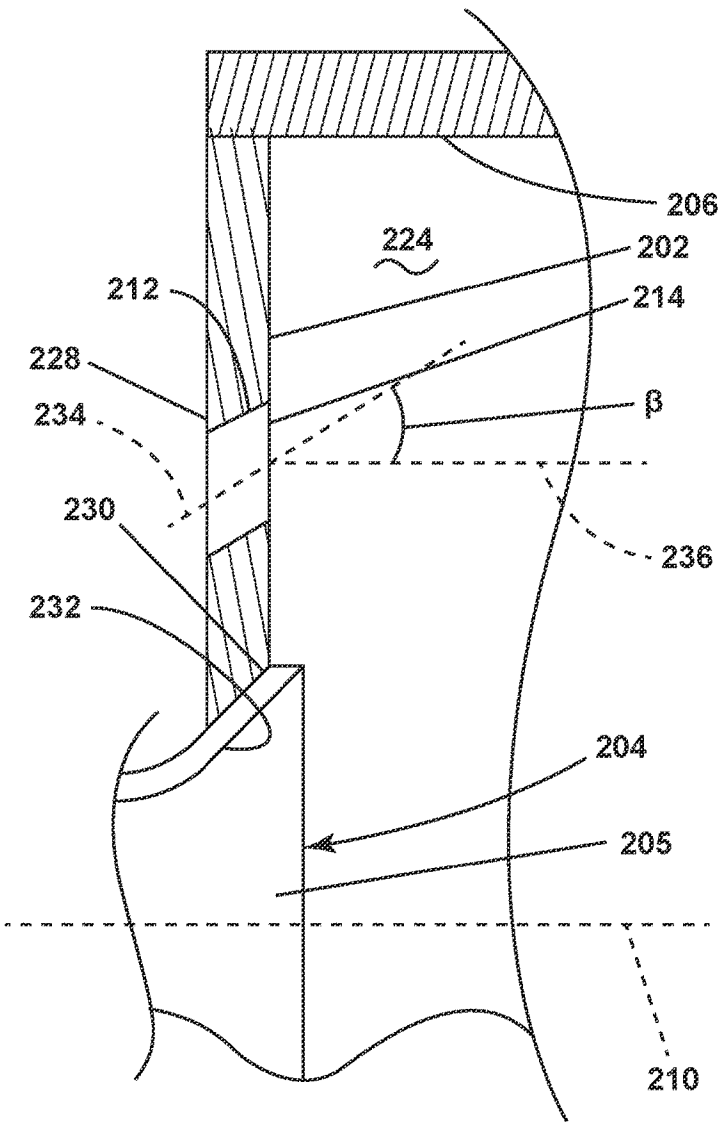
FIG. 6 is a partial side cross-sectional view of a portion of the first dilution passage arrangement as seen from line VI of FIG. 4, illustrating the first passage angle defining a second orientation for the dilution passage.
Figure 7:
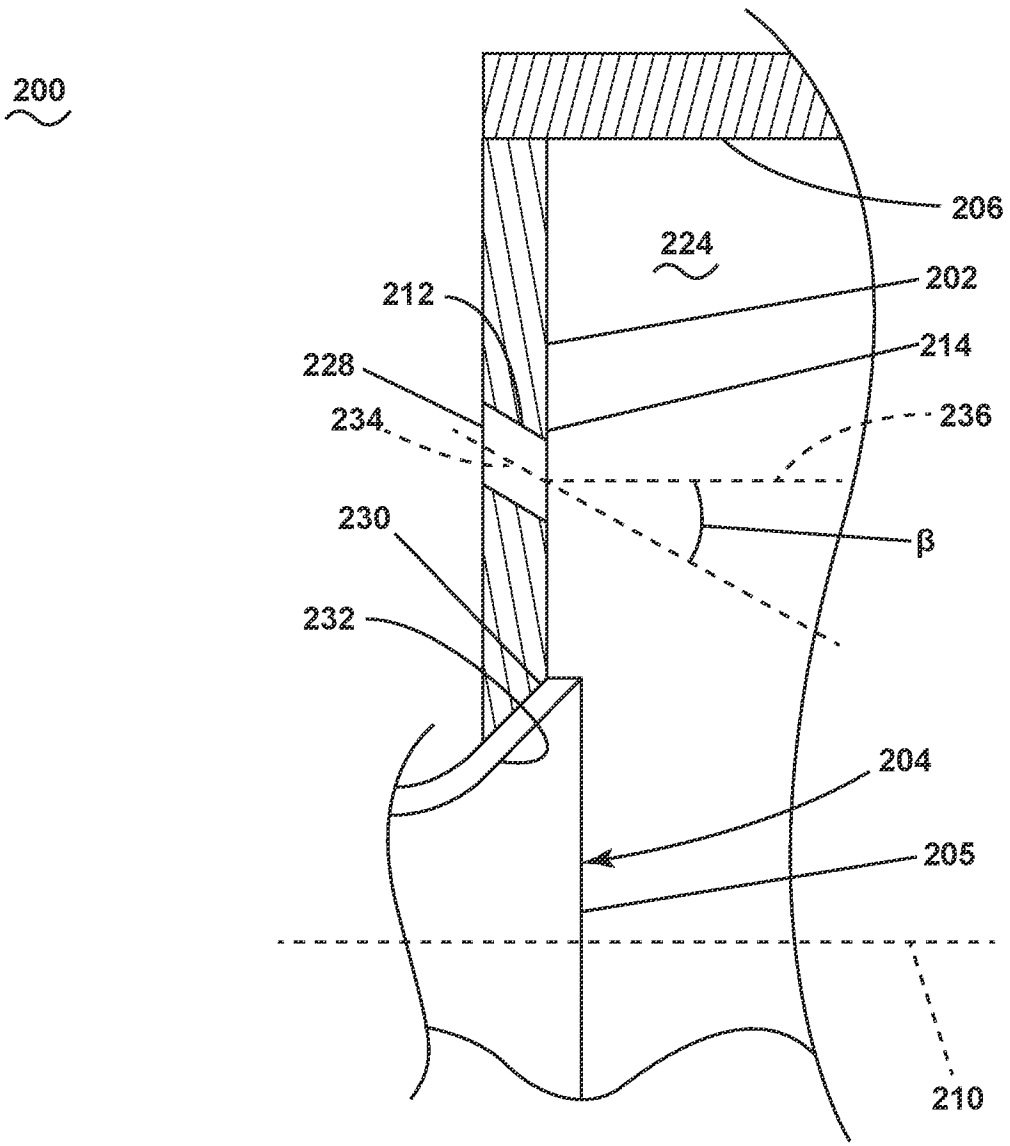
FIG. 7 is a partial side cross-sectional view of a portion of the first dilution passage arrangement of FIG. 4 as seen from line VII of FIG. 4, illustrating the first passage angle defining a third orientation for the dilution passage.

FIGS. 5-7 illustrate various non-limiting configurations of the plurality of dilution passages 212 extending through the dome wall 202. Each dilution passage 212 extends between an inlet 228 and a respective slot 214. The passage centerline 234 extends linearly or non-linearly. The fuel cup 204 includes a flare cone 230 with a flared surface 232 opening up to the outlet 205. The dome wall 202, the outer liner 206 and the inner liner 208 (FIG. 4) at least partially define a combustion chamber 224. The outlet 205 of the fuel cup 204 and the slot 214 of the dilution passage 212 are each directly fluidly coupled to respective portions of the combustion chamber 224. It will be appreciated that the dilution passage 212 can take any suitable form and include any other suitable structure. As a non-limiting example, the inlet 228 can flare outwardly to define a funnel or otherwise include a chute that extends axially from the dome wall 202, with respect to the passage centerline 234.

FIG. 5 illustrates a partial cross-sectional side view of a dilution passage 212 of the plurality of dilution passages 212 seen from line V of FIG. 4. The passage centerline 234 of the illustrated dilution passage 212 extends parallel to the fuel cup centerline 210 forming an axial dilution passage.

The passage centerline 234, specifically where the passage centerline 234 at the slot 214 (e.g., the center point of the slot 214), is provided a first radial height (Rh1) from the fuel cup centerline 210. The slot 214 is defined by a slot width (Sw). The dilution passage 212 extends from the inlet 228 to the slot 214 a total axial length (La), with respect to the fuel cup centerline 210. The outlet 205 of the fuel cup 204 extends a second radial height (Rh2) from the fuel cup centerline 210. The outlet 205, as a non-limiting example, is circular such that the second radial height (Rh2) is a radius of the outlet 205 and that two times the second radial height (Rh2) is the width of the outlet 205.

A ratio between the second radial height (Rh2) and the first radial height (Rh1) is greater than or equal to 1 and less than or equal to 3. A ratio of the slot width (Sw) to the width of the outlet 205 (e.g., two times the second radial height (Rh2)) is greater than or equal to 0.03 and less than or equal to 0.5. The slot width (Sw) can be any suitable size such as greater than or equal to 0.04 inches. A ratio between the total axial length (La) to the slot width (Sw) can be greater than or equal to 0.1 and less than or equal to 10.

It has been found that conforming the first dilution passage arrangement 200 and the fuel cup 204 to the above-described ratios and ranges provides a distinct benefit when compared to a dilution passage arrangement 200 and fuel cup 204 that does not fall within the aforementioned ratios and ranges. These benefits will be described later in the specification with respect to FIG. 9.

FIG. 6 illustrates a partial cross-sectional side view of a dilution passage 212 of the plurality of dilution passages 212 seen from line VI of FIG. 4. The passage centerline 234 of the illustrated dilution passage 212 extends radially outward from the fuel cup centerline 210 forming an outward dilution passage. The passage centerline 234 forms a first passage angle (B) with respect to a projection 236 of the fuel cup centerline 210.

FIG. 7 illustrates a partial cross-sectional side view of a dilution passage 212 of the plurality of dilution passages 212 seen from line VII of FIG. 4. The passage centerline 234 of the illustrated dilution passage 212 extends radially inward towards the fuel cup centerline 210 forming an inward dilution passage. The passage centerline 234 forms a first passage angle (β) with respect to the projection 236 of the fuel cup centerline 210.

The first passage angle (β) can be any suitable angle that is greater than or equal to negative 70 degrees and less than or equal to 70 degrees.

While illustrated as the plurality of dilution passages 212 including the axial dilution passages 212, the outward dilution passages 212 and the inward dilution passages 212, it will be appreciated that the plurality of dilution passages 212 can be formed as only axial dilution passages 212, only outward dilution passages 212, only inward dilution passages 212, or any suitable combination thereof.

Figure 8:
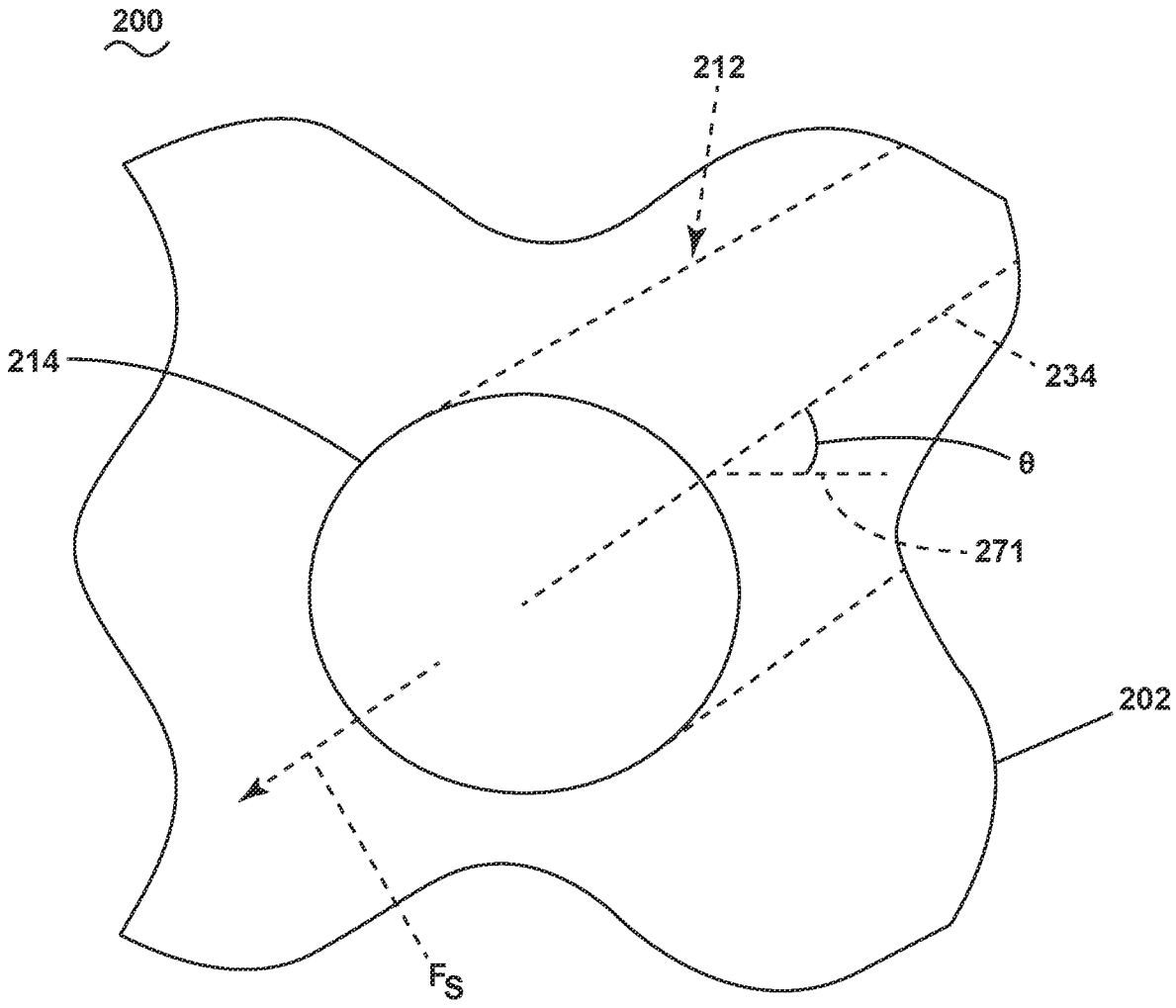
FIG. 8 is an enlarged, schematic, front view of the dome wall as seen from section VIII of FIG. 4, the dilution passage including a second passage angle.

FIG. 8 is an enlarged schematic front view of the dome wall 202 as seen from section VIII of FIG. 4. As illustrated, the dilution passage 212 includes a respective passage centerline 234 that forms a second passage angle (θ) with respect to a projection 271 of the transverse reference line 270 (FIG. 4). The second passage angle (θ) can have an absolute value of greater than or equal to 0 degrees and less than or equal to 90 degrees. As a non-limiting example, the absolute value of the second passage angle (θ) of at least a portion of the dilution passages 212 can be greater than or equal to 0 degrees and less than or equal to 30 degrees. It will be further appreciated that at least a portion of the dilution passages 212 can be formed without a second passage angle (θ) such that they extend into the illustrated page and coincide with, or otherwise circumscribe, the slot 214.

A slot airflow (Fs) can flow outward from the slot 214. The slot airflow (Fs) can include the second passage angle (θ) at the slot 214. As such, the slot airflow (Fs) can be defined by a circumferential component, with respect to the fuel cup centerline 210. The circumferential component of the slot airflow (Fs) can be in line with/parallel with, or counter to/non-parallel with the circumferential component of the fuel air mixture (F1) (FIG. 4).

Figure 9:
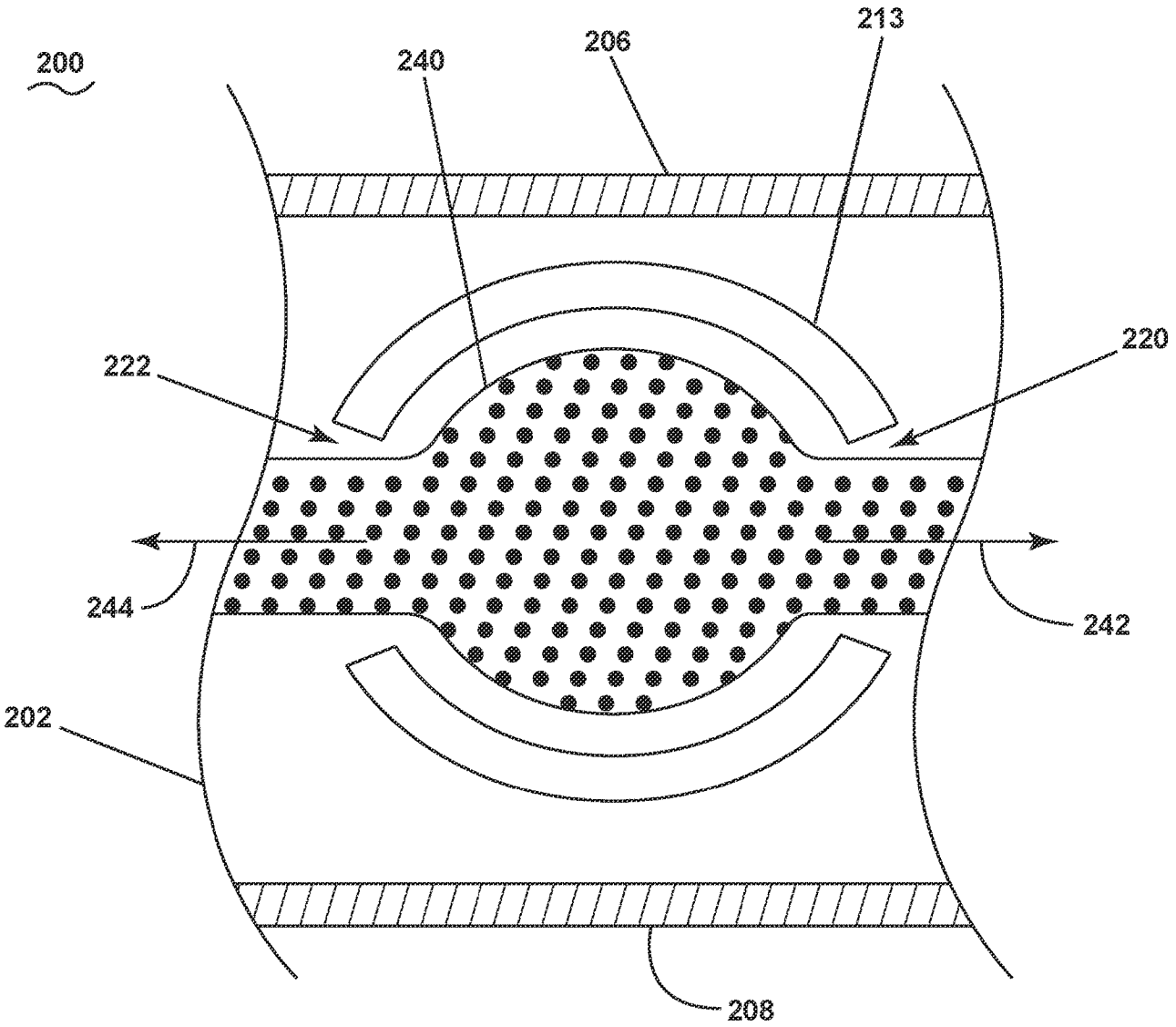
FIG. 9 is a schematic, front view of the dome wall including the dilution passage arrangement of FIG. 4, further illustrating a flame shaping attributable to the dilution passages.

FIG. 9 is a schematic front view of the dome wall 202 of FIG. 4 having the same view of FIG. 4. The dilution passage arrangement 200 includes a slot-present region 213 extending between opposing breaks 220, 222. Any number of one or more slots of the plurality of slots 214 (FIG. 4) are provided within each slot-present region 213. During operation, the fuel air mixture (F1) is ignited to define a flame 240, and a compressed airflow is fed through the plurality of dilution passages 212. The compressed airflow forms a curtain around at least a portion of the circumferential extent of the flame 240. The flame 240, however, is free to flow through the first break 220 and the second break 222 in the directions indicated by arrows 242, 244, respectively.

A plurality of fuel cups 204 (FIG. 4) are circumferentially arranged about the dome wall 202. Each fuel cup 204 can include a respective first dilution passage arrangement 200. The dilution passage arrangements 200 can be the same or different between fuel cups 204. It is contemplated that the first break 220 of a first dilution passage arrangement 200 can be at least partially aligned with a second break 222 of a second dilution passage arrangement 200 that is circumferentially adjacent to the first dilution passage arrangement 200. The flame 240 that spreads through the first break 220 of the first dilution passage arrangement 200 can meet with and merge with the flame 240 that spreads through the second break 222 of the second dilution passage arrangement 200. This merging flames 240 ensures that a continuous annular ring of flame is formed along the dome wall 202, which ensures flame propagation from one fuel cup 204 to another and reduces the likelihood of a flameout at any given one of the fuel cups 204.

The flow of compressed air flowing through the slots 214 (FIG. 4) can be defined by a total slot flow. The fuel air mixture (F1) can further be defined by a total fuel cup flow. The total slot flow and the total fuel cup flow are each defined by a volume of fluid (e.g., compressed air or fuel/air mixture, respectively) that flows through the respective slots 214 or fuel cup 204 (FIG. 4) over a period of time (e.g., milliliters/second). The ratio between the total slot flow and the total fuel cup flow can be greater than or equal to 0.2 and less than or equal to 4.

The curtain of compressed air from the dilution passages 212 is used for a multitude of reasons. First, the curtain of compressed air prevents the flame 240 from contacting or otherwise overly heating the dome wall 202, the outer liner 206 and the inner liner 208. This, in turn, ensures that that dome wall 202, the outer liner 206, the inner liner 208 or any portions of the combustor (e.g., the combustor 80 of FIG. 3) or gas turbine engine (e.g., the gas turbine engine 10 of FIG. 1) outside of the dome wall 202, the inner liner 208 or the outer liner 206 are not damaged or otherwise overly heated by the flame 240. Second, the curtain of compressed air is used to shape the flame 240. The flame shaping can be done, in part, by the first passage angle (β) (FIGS. 6 and 7) or the second passage angle (θ) (FIG. 8). For example, an outward dilution passage 212 (FIG. 6) will allow the flame 240 to expand, thereby generating a flame 240 with a larger surface area, while an inward dilution passage 212 (FIG. 7) will compress or constrict the flame 240, thereby generating a flame 240 with a smaller surface area.

Further, the orientation of or the inclusion of the second passage angle (θ) can be used to provide a hydrodynamic curtain of compressed air oriented with respect to the fuel air mixture (F1). It has been found that the orientation of the curtain of compressed air can be used to shape and direct the flame 240. As a non-limiting example, when the circumferential component of the curtain of compressed air is non-parallel to the circumferential component of the fuel/air mixture (F1), the curtain of compressed air is better adapted to directing the flame 240 away from the outer liner 206 and the inner liner 208. As a non-limiting example, when the circumferential component of the curtain of compressed air is parallel to the circumferential component of the fuel air mixture (F1), the curtain of compressed air is better adapted to directing the flame 240 away from the dome wall 202. When the fuel/air mixture (F1) does not include a circumferential component, the curtain of compressed air is used to swirl the fuel/air mixture in a desired fashion.

The curtain of compressed air can further be used to ensure that the combustor (e.g., the combustor 80 of FIG. 2) including the first dilution passage arrangement 200 can use fuels with high burn temperatures, and burning at fast flame speeds, such as hydrogen-containing fuels. As hydrogen-containing fuels have a significantly higher burn temperature than traditional hydrocarbon fuels, it becomes more important to insulate the flame 240 from the dome wall 202, the outer liner 206 and the inner liner 208 and to cool the dome wall 202, the outer liner 206 and the inner liner 208. The air curtain that is generated through the first dilution passage arrangement 200 is used to provide a layer of insulation (e.g., the curtain of compressed air) between the flame 240 and the dome wall 202, the outer liner 206 and the inner liner 208 and to cool the dome wall 202, the outer liner 206 and the inner liner 208 and to direct the flame 240 away from the dome wall 202, the outer liner 206 and the inner liner 208.

It is contemplated that the ratio of Rh2:Rh1 being greater than or equal to 1 and less than or equal to 3 results in a desirable shaping of the flame 240 that does not overly heat the outer liner 206, the inner liner 208 or the dome wall 202 while still having desired properties of the flame 240. For example, if the ratio of Rh2:Rh1 were greater than 3, it has been found that the flame 240 expands radially outward, with respect to the fuel cup centerline 210 (FIG. 4), and impinges the inner liner 208 and outer liner 206, resulting in an overheating of the inner liner 208 and outer liner 206. If, however, the ratio of Rh2:Rh1 were less than 1, it has been found that the flame 240 is too centered around a central region defined by the fuel cup centerline 210, which in turn results in an undesirable profile and pattern of the flame 240.

It is contemplated that the ratio of the slot width (Sw) to the width of the outlet 205 being greater than or equal to 0.03 and less than or equal to 0.3 results in a plurality of slots 214 that have a sufficient flow rate of compressed air with respect to a flow rate of the fuel and air mixture (F1) flowing from the fuel cup 204 in order to produce a desirable shape of the flame 240. If the ratio of the of the slot width (Sw) to the width of the outlet 205 were larger than 0.3, it has been found that too much compressed air exits the plurality of slots 214, resulting in the flame 240 having too high of a velocity or otherwise being overly compressed. If, however, the ratio of the slot width (Sw) to the width of the outlet 205 is smaller than 0.03, it has been found that the compressed air exiting the plurality of slots 214 is not sufficient in creating in the curtain of compressed air that insulates the dome wall 202, the outer liner 206 and the inner liner 208 from the heat of the flame 240, nor does the curtain of compressed air have enough force to shape the flame 240 in the desired pattern.

It is contemplated that the ratio between the total axial length (La) to the slot width (Sw) being greater than or equal to 0.1 and less than or equal to 10 results in a desired velocity of the compressed air exiting the plurality of slots 214. For example, if the ratio between the total axial length (La) to the slot width (Sw) were greater than 10, the total axial length (La) is longer, meaning that the compressed air flowing through the dilution passage 212 will frictional losses, which ultimately lowers the kinetic energy, as opposed to a lower total axial length (La). This reduction in the kinetic energy due to frictional losses ultimately results in a combustor with unsatisfactory performance when compared to a combustor falling within the desired total axial length (La) to slot width (Sw) ratio. If, however, the ratio between the total axial length (La) to the slot width (Sw) were less than 0.1, it has been found that the losses (e.g., windage losses) associated with the compressed air entering the combustion chamber and merging with the fuel and air mixture (F1) within the combustion chamber. These losses ultimately results in a combustor with unsatisfactory performance when compared to a combustor falling within the desired total axial length (La) to slot width (Sw) ratio.

Figure 10:
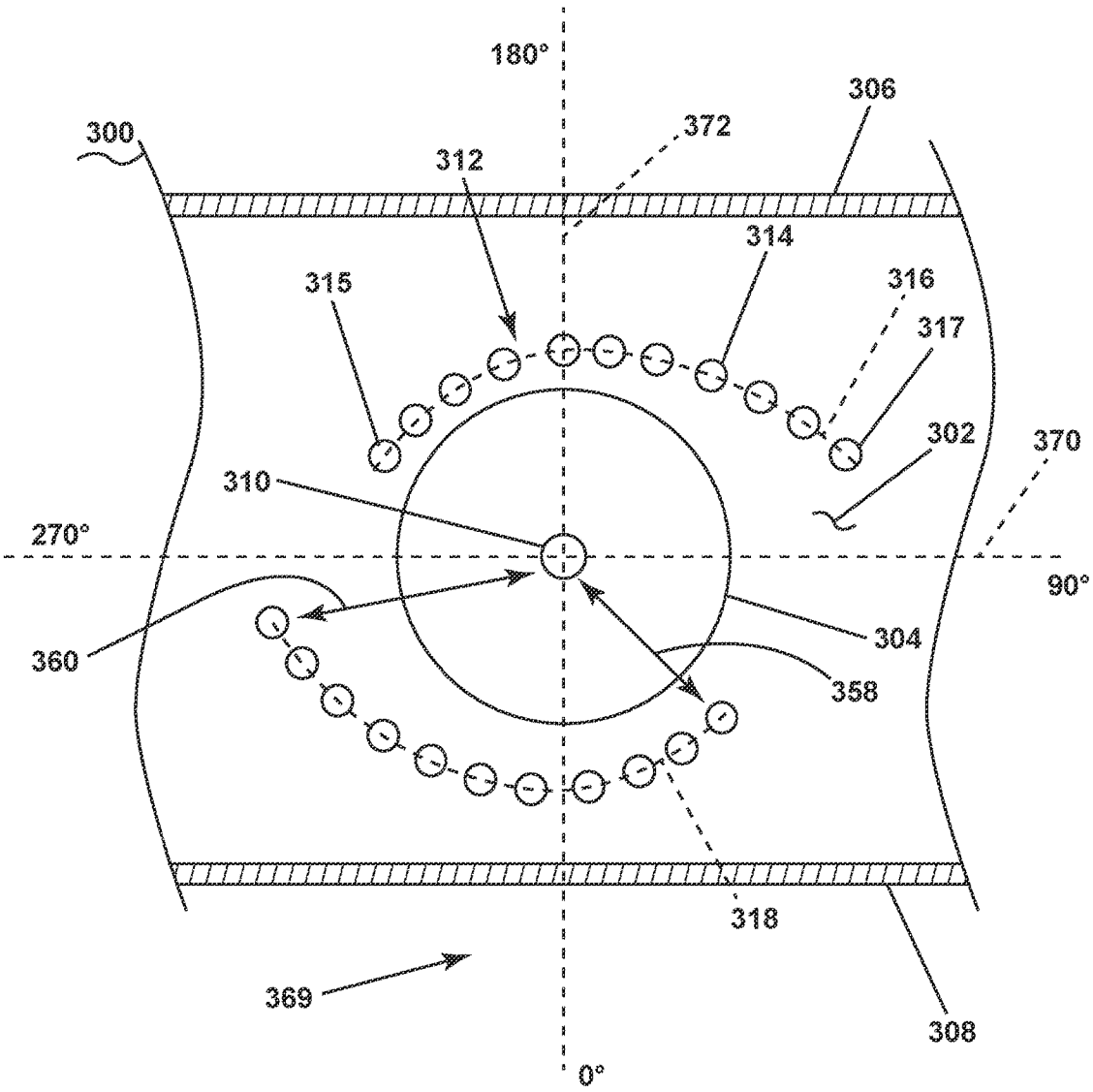
FIG. 10 is a schematic, transverse view of a second dilution passage arrangement suitable for use as the dilution passage arrangement of FIG. 4, the dilution passage arrangement including a plurality of slots that follow a spiral pattern.

FIG. 10 is a schematic, transverse cross-sectional view of an exemplary second dilution passage arrangement 300 suitable for use as the first dilution passage arrangement 200 of FIG. 4. The second dilution passage arrangement 300 is similar to the first dilution passage arrangement 200, therefore, like parts will be identified by like numerals increased to the 300 series, with it being understood that the description of the first dilution passage arrangement 200 applies to the second dilution passage arrangement 300, unless otherwise noted.

The second dilution passage arrangement 300 is provided on a dome wall 302 and surrounding a fuel cup 304 having a fuel cup centerline 310. The dome wall 302 extends radially between an outer liner 306 and an inner liner 308. A plurality of dilution passages 312 extend through the dome wall 302 and terminate in a plurality of slots 314 formed along the dome wall 302. The second dilution passage arrangement 300 is provided along a polar coordinate system 369 having a fuel cup reference line 372 extending from 0 degrees to 180 degrees and a transverse reference line 370 extending from 90 degrees to 270 degrees. The plurality of slots 314 extend along, at least, a first line 316 and a second line 318.

The second dilution passage arrangement 300 is similar to the first dilution passage arrangement 200, except that the first line 316 and the second line 318 each serially increase in a radial distance from the fuel cup centerline 310 from a first slot 315 of the plurality of slots 314 to a second slot 317 of the plurality of slots 314. The first slot 315 and the second slot 317 can define circumferential ends of the first line 316 or the second line 318, such that the radial distance increases from one circumferential end (e.g., the first slot 315 or the second slot 317) to a second circumferential end (e.g., another of the first slot 315 or the second slot 317) along the respective first line 316 or the second line 318. The first slot 315 and the second slot 317 being provided on circumferentially opposite ends of the first line 316 and the second line 318. The first slot 315 is a first radial distance 358 from the fuel cup centerline 310. The second slot 317 is a second radial distance 360 from the fuel cup centerline 310. The first radial distance 358 is smaller than the second radial distance 360. The radial distances of the slots 314 circumferentially between the first slot 315 and the second slot 317 can increase serially in a continuous or non-continuous fashion such that the first radial distance 358 is the smallest and the second radial distance 360 is the largest. This configuration can, for example, form a spiral pattern of slots 314 along the dome wall 302.

The benefit of including the spiral pattern, or serially-increasing radial heights, is that the second dilution passage arrangement 300 can be used to further shape the flame (e.g., the flame 240 of FIG. 10) that exits the fuel cup 304 similar to how the second passage angle (e.g., the second passage angle (θ) of FIG. 8) is used to shape the flame. For example, the first line 316 and the second line 318 can form a spiral that extends circumferentially (e.g., from the first slot 315 to the second slot 317) parallel to or counter to the circumferential direction of the fuel air mixture (e.g., the fuel air mixture (F1)) leaving the fuel cup 304.

Figure 11:
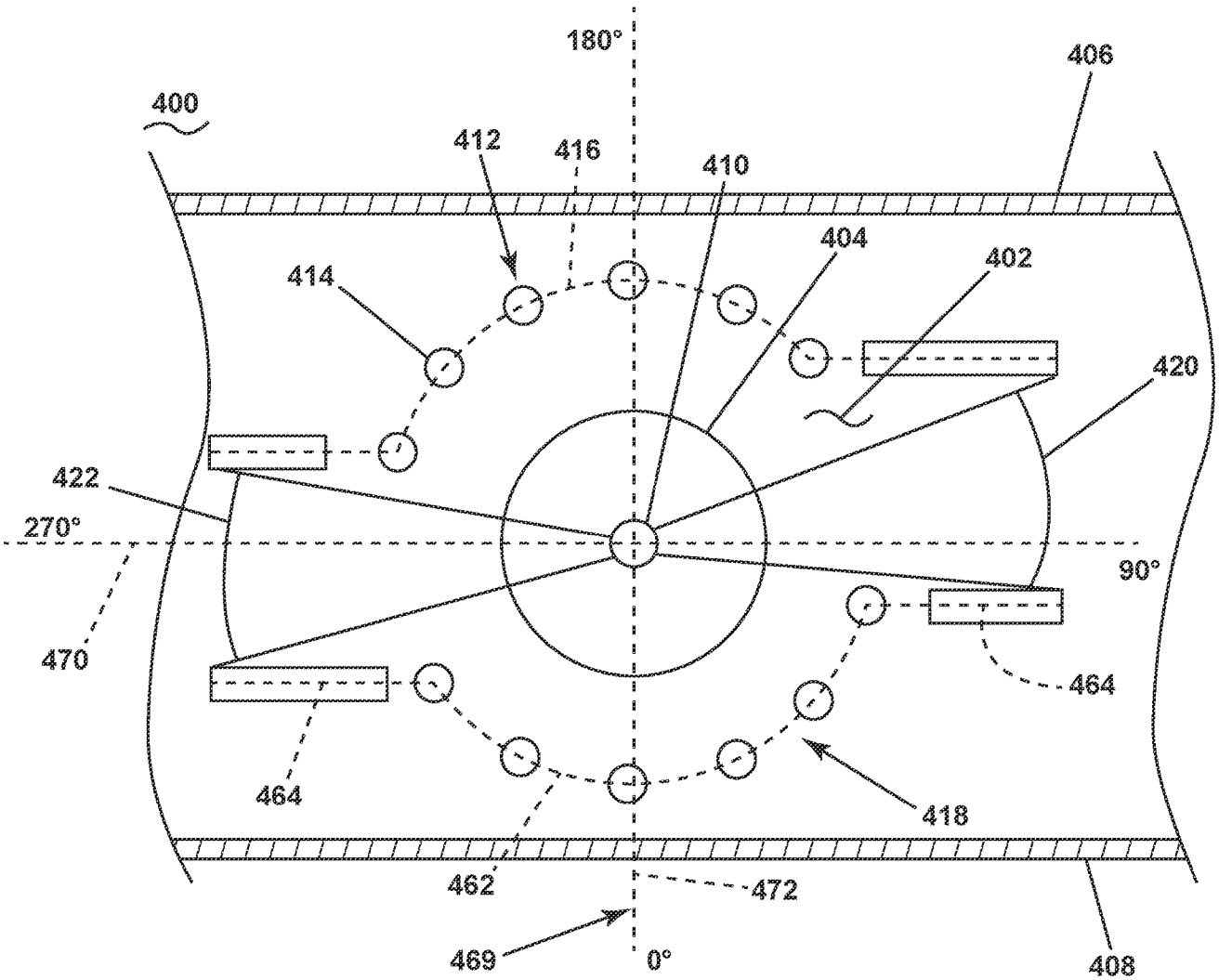
FIG. 11 is a schematic, transverse view of a third dilution passage arrangement suitable for use as the dilution passage arrangement of FIG. 4, the dilution passage arrangement including a first subset of slots following a curved line and a second subset of slots following a linear line.

FIG. 11 is a schematic, transverse cross-sectional view of an exemplary third dilution passage arrangement 400 suitable for use as the first dilution passage arrangement 200 of FIG. 4. The third dilution passage arrangement 400 is similar to the dilution passage arrangement 200, 300 (FIG. 10), therefore, like parts will be identified by like numerals increased to the 400 series, with it being understood that the description of the dilution passage arrangement 200, 300 applies to the third dilution passage arrangement 400, unless otherwise noted.

The third dilution passage arrangement 400 is provided on a dome wall 402 and surrounding a fuel cup 404 having a fuel cup centerline 410. The dome wall 402 extends radially between an outer liner 406 and an inner liner 408. A plurality of dilution passages 412 extend through the dome wall 402 and terminate in a plurality of slots 414 formed along the dome wall 402. The third dilution passage arrangement 400 is provided along a polar coordinate system 469 having a fuel cup reference line 472 extending from 0 degrees to 180 degrees and a transverse reference line 470 extending from 90 degrees to 270 degrees. The plurality of slots 414 extend along, at least, a first line 416 and a second line 418. The third dilution passage arrangement 400 includes a first break 420 and a second break 422.

The third dilution passage arrangement 400 is similar to the dilution passage arrangement 200, 300, except that the first line 416 and the second line 418 each include at least two non-parallel or non-uniform portions. As a non-limiting example, the first line 416 and the second line 418 each include a curved line 462 and at least one linear line 464. The curved line 462 can include two circumferential ends and the at least one linear line 464 can extends outwardly from one of the two circumferential ends of the curved line 462. As a non-limiting example, the first line 416 and the second line 418 each include the curved line 462 and the at least one linear line 464 including a first linear line extending from a first circumferential end of the curved line 462 and a second linear line extending from a second circumferential end of the curved line 462. The two linear lines 464 can each be formed identical or non-identical to one another. The linear lines 464 can extend parallel with or non-parallel to the transverse reference line 470. There can be any number of one or more slots on the curved line 462 and the linear lines 464 of the first line 416 and the second line 418.

The linear lines 464 can correspond to an extend along the first break 420 and the second break 422 and extend radially outward from, with respect to the fuel cup centerline 410, respective portions of the corresponding curved line 462. As such, the linear lines 464 can form a channel for the first break 420 and the second break 422, The slots 414 provided on the first line 416 and the second line 418 can each be defined by a respective cross-sectional area. The cross-sectional area of the slots 414 can be equal to or non-equal to the cross-sectional area of the slots 414 on the second line 418. The cross-sectional area of the slots 414 can be constant or differ along the respective first line 416 and the second line 418. As a non-limiting example, the slots 414 on the curved line 462 can have a circular cross-sectional area while the slots 414 on the linear lines 464 can have an oblong cross-sectional area. The oblong cross-sectional area can be used to create elongated troughs extending along the first break 420 and the second break 422.

Figure 12:
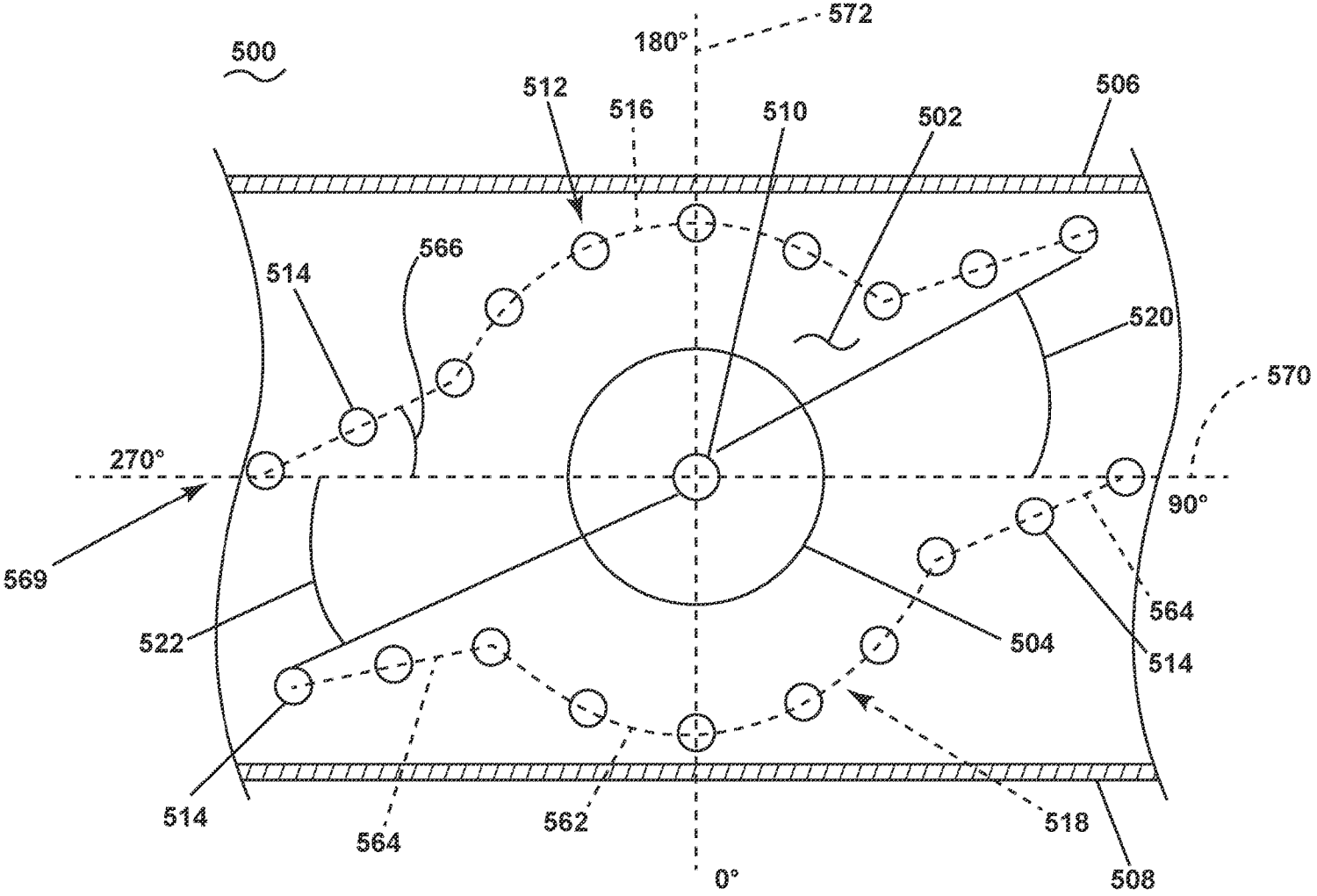
FIG. 12 is a schematic, transverse view of a fourth dilution passage arrangement suitable for use as the dilution passage arrangement of FIG. 4, the dilution passage arrangement including a first subset of slots following a curved line and a second subset of slots following a linear line that is extends non-circumferentially about the dome wall.

FIG. 12 is a schematic, transverse view of an exemplary fourth dilution passage arrangement 500 suitable for use as the first dilution passage arrangement 200 of FIG. 4. The fourth dilution passage arrangement 500 is similar to the dilution passage arrangement 200, 300 (FIG. 10), 400 (FIG. 11), therefore, like parts will be identified by like numerals increased to the 500 series, with it being understood that the description of the dilution passage arrangement 200, 300, 400 applies to the fourth dilution passage arrangement 500, unless otherwise noted.

The fourth dilution passage arrangement 500 is provided on a dome wall 502 and surrounding a fuel cup 504 having a fuel cup centerline 510. The dome wall 502 extends radially between an outer liner 506 and an inner liner 508. A plurality of dilution passages 512 extend through the dome wall 502 and terminate in a plurality of slots 514 formed along the dome wall 502. The fourth dilution passage arrangement 500 is provided along a polar coordinate system 569 having a fuel cup reference line 572 extending from 0 degrees to 180 degrees and a transverse reference line 570 extending from 90 degrees to 270 degrees. The plurality of slots 514 extend along, at least, a first line 516 and a second line 518. The fourth dilution passage arrangement 500 includes a first break 520 and a second break 522.

The fourth dilution passage arrangement 500 is similar to the third dilution passage arrangement 400 in that it includes the first line 516 and the second line 518, each defined by a curved line 562 and at least one linear line 564 (e.g., two linear lines 564). The difference, however, is that the at least one linear line 564 extends at an angle 566 with respect to the transverse reference line 570. An absolute value of the angle 566 can be greater than or equal to 0 degrees and less than or equal to 60 degrees.

With reference to FIGS. 11 and 12, the benefit of the dilution passage arrangements 400, 500 is further directing and shaping of the flame (e.g., the flame 240 of FIG. 10). For example, the channel formed by the linear lines 464, 564 can be used to direct or otherwise channel the flame from one dilution passage arrangement 400, 500 to another, circumferentially adjacent dilution passage arrangement 400, 500.

Figure 13:
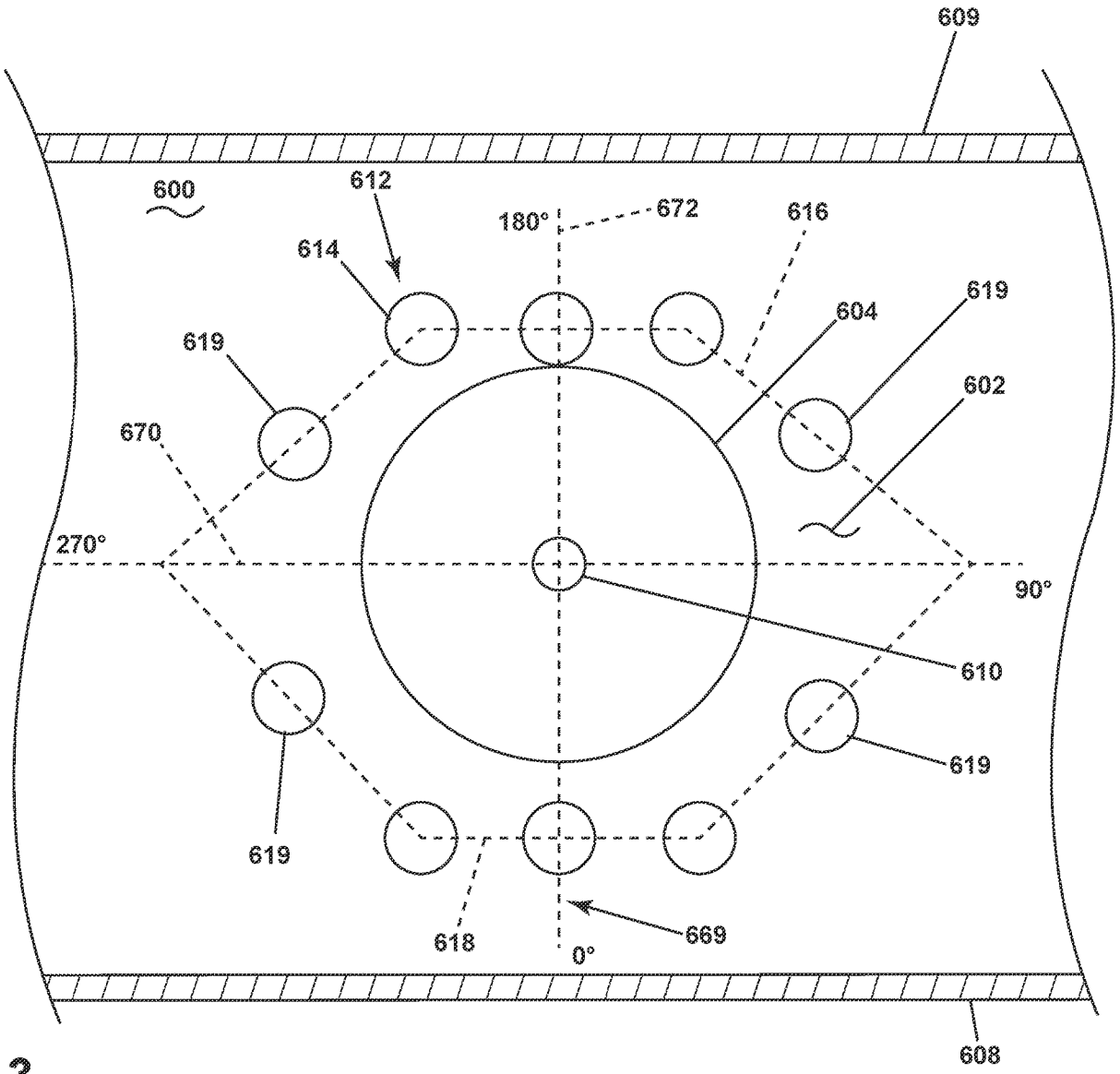
FIG. 13 is a schematic, transverse view of a fifth dilution passage arrangement suitable for use as the dilution passage arrangement of FIG. 4, the dilution passage arrangement including a plurality of slots following a non-circular polygonal path.

FIG. 13 is a schematic, transverse view of an exemplary fifth dilution passage arrangement 600 suitable for use as the first dilution passage arrangement 200 of FIG. 4. The fifth dilution passage arrangement 600 is similar to the dilution passage arrangement 200, 300 (FIG. 10), 400 (FIG. 11), 500 (FIG. 12), therefore, like parts will be identified by like numerals increased to the 600 series, with it being understood that the description of the dilution passage arrangement 200, 300, 400, 500 applies to the fifth dilution passage arrangement 600, unless otherwise noted.

The fifth dilution passage arrangement 600 is provided on a dome wall 602 and surrounding a fuel cup 604 having a fuel cup centerline 610. The dome wall 602 extends radially between an outer liner 606 and an inner liner 608. A plurality of dilution passages 612 extend through the dome wall 602 and terminate in a plurality of slots 614 formed along the dome wall 602 The fifth dilution passage arrangement 600 is provided along a polar coordinate system 669 having a fuel cup reference line 672 extending from 0 degrees to 180 degrees and a transverse reference line 670 extending from 90 degrees to 270 degrees. The plurality of slots 614 extend along, at least, a first line 616 and a second line 618.

For purposes of illustration, the first line 616 and the second line 618 are projected outwardly beyond outside slots 619 of the plurality of slots 614 along the first line 616 and the second line 618 based on a trajectory of the first line 616 and second line 618 at the outside slots 619. As illustrated, the first line 616 and the second line 618 meet to form a continuous polygonal path about the fuel cup centerline 610. The polygonal path can be any suitable circular or non-circular path.

The first line 616 and the second line 618 can meet at two location along the transverse reference line 670. Alternatively, the first line 616 and the second line 618 can meet at any suitable location along the dome wall 602.

Figure 14:
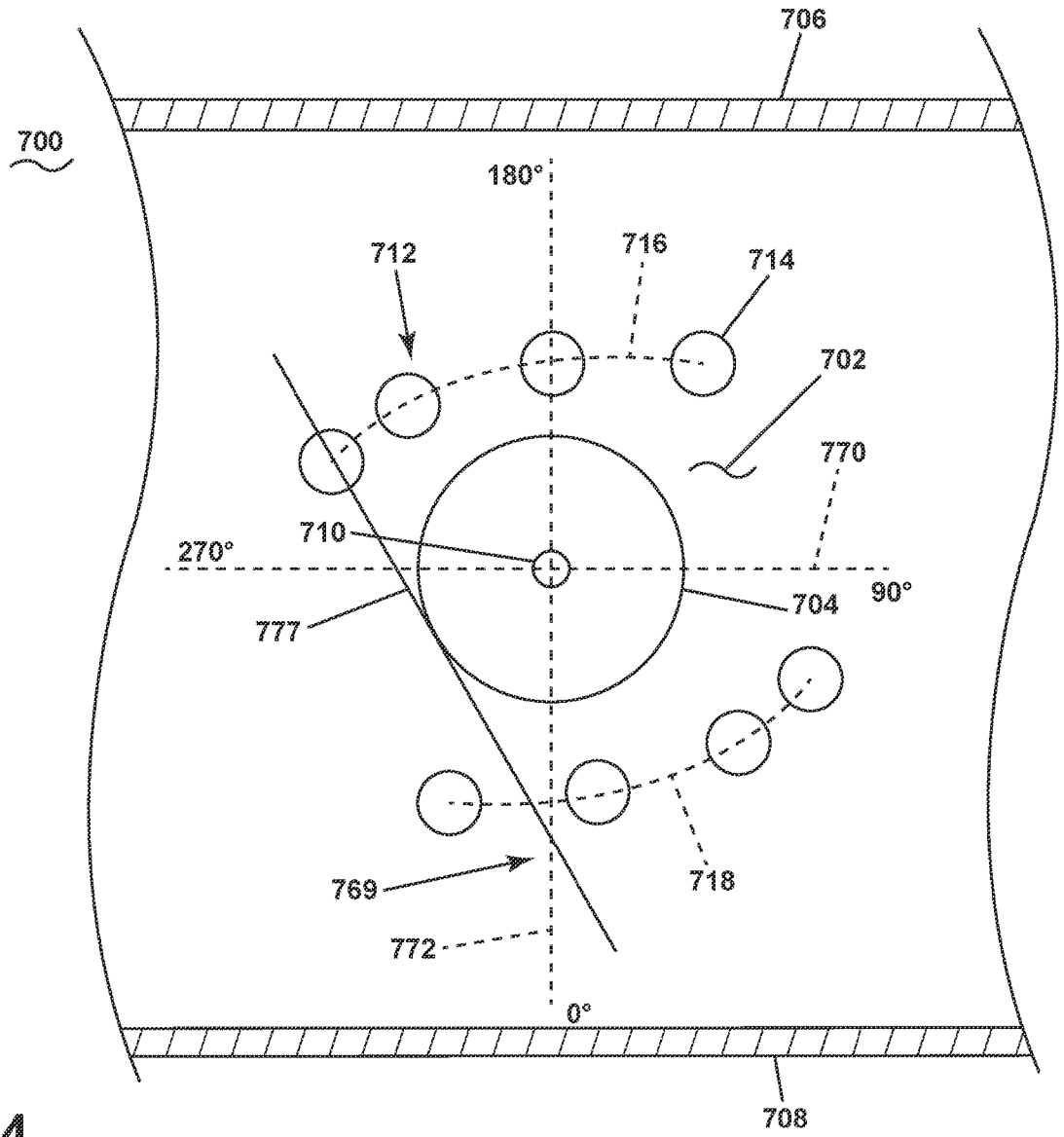
FIG. 14 is a schematic, transverse view of a sixth dilution passage arrangement suitable for use as the dilution passage arrangement of FIG. 4, the dilution passage arrangement including a plurality of slots with a non-symmetrical formation.

FIG. 14 is a schematic, transverse view of an exemplary sixth dilution passage arrangement 700 suitable for use as the first dilution passage arrangement 200 of FIG. 4. The sixth dilution passage arrangement 700 is similar to the dilution passage arrangement 200, 300 (FIG. 10), 400 (FIG. 11), 500 (FIG. 12), 600 (FIG. 13), therefore, like parts will be identified by like numerals increased to the 700 series, with it being understood that the description of the dilution passage arrangement 200, 300, 400, 500, 600 applies to the sixth dilution passage arrangement 700, unless otherwise noted.

The sixth dilution passage arrangement 700 is provided on a dome wall 702 and surrounding a fuel cup 704 having a fuel cup centerline 710. The dome wall 702 extends radially between an outer liner 706 and an inner liner 708. A plurality of dilution passages 712 extend through the dome wall 702 and terminate in a plurality of slots 714 formed along the dome wall 702. The sixth dilution passage arrangement 700 is provided along a polar coordinate system 769 having a fuel cup reference line 772 extending from 0 degrees to 180 degrees and a transverse reference line 770 extending from 90 degrees to 270 degrees. The plurality of slots 714 extend along, at least, a first line 716 and a second line 718.

The sixth dilution passage arrangement 700 is similar to the dilution passage arrangement 200, 300, 400, 500, 600, except that the sixth dilution passage arrangement 700 is non-symmetrical about both the transverse reference line 770 and the fuel cup reference line 772. The sixth dilution passage arrangement 700 can further include a plurality of slots 714 that are non-uniformly and non-equally distributed along the dome wall 702. In other words, the sixth dilution passage arrangement 700 can include any random or non-random distribution of slots 714 along the dome wall 702. As a non-limiting example, at least one slot 714 can lay along a tangent line 777 extending from the fuel cup 204.

Figure 15:
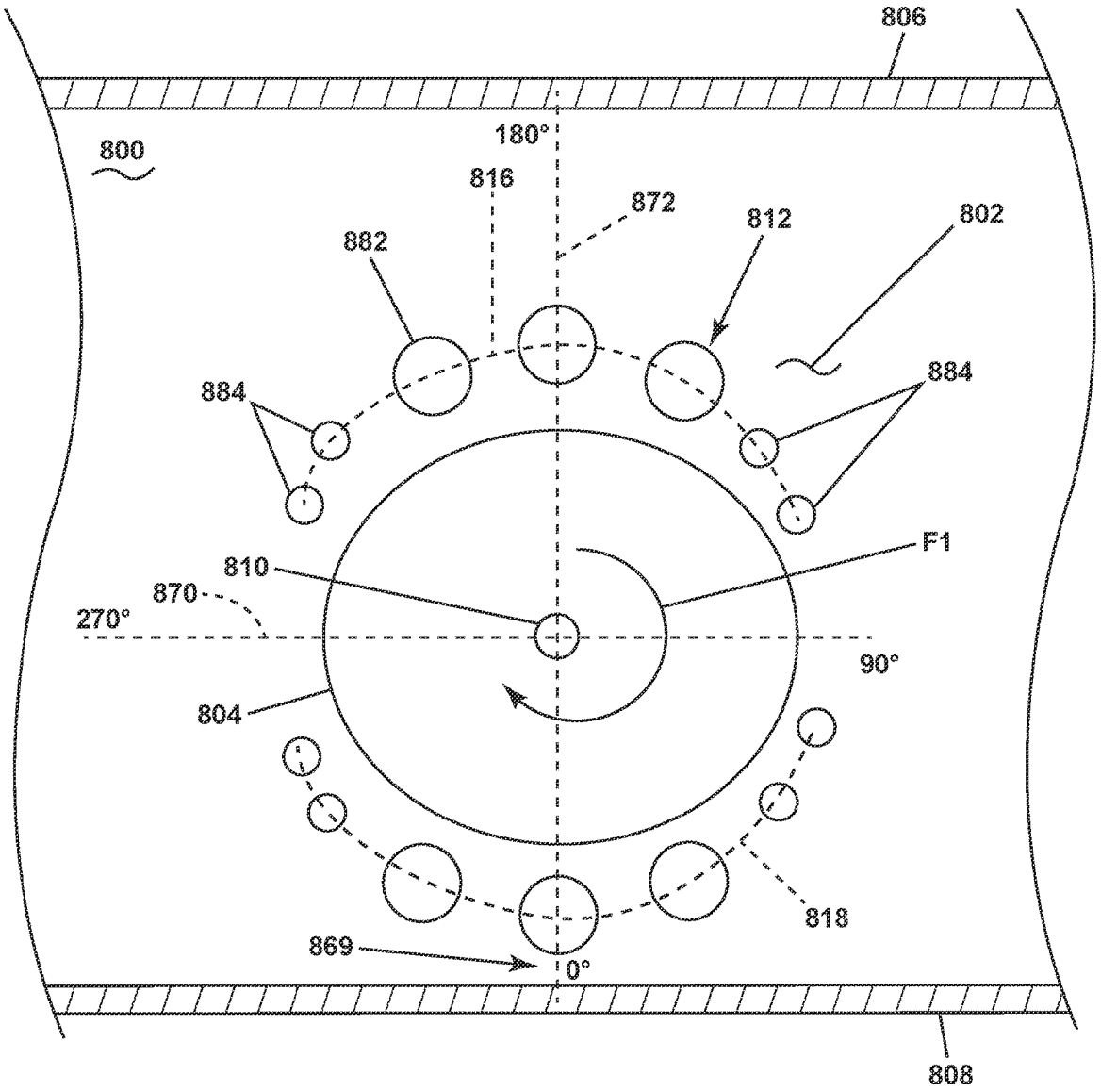
FIG. 15 is a schematic, transverse view of a seventh dilution passage arrangement suitable for use as the dilution passage arrangement of FIG. 4, the dilution passage arrangement including a plurality of slots having differing cross-sectional areas.

FIG. 15 is a schematic, transverse view of an exemplary seventh dilution passage arrangement 800 suitable for use as the first dilution passage arrangement 200 of FIG. 4. The seventh dilution passage arrangement 800 is similar to the dilution passage arrangement 200, 300 (FIG. 10), 400 (FIG. 11), 500 (FIG. 12), 600 (FIG. 13), 700 (FIG. 14), therefore, like parts will be identified by like numerals increased to the 800 series, with it being understood that the description of the dilution passage arrangement 200, 300, 400, 500, 600, 700 applies to the seventh dilution passage arrangement 800, unless otherwise noted.

The seventh dilution passage arrangement 800 is provided on a dome wall 802 and surrounding a fuel cup 804 having a fuel cup centerline 810. The dome wall 802 extends radially between an outer liner 806 and an inner liner 808. A plurality of dilution passages 812 extend through the dome wall 802. The seventh dilution passage arrangement 800 is provided along a polar coordinate system 869 having a fuel cup reference line 872 extending from 0 degrees to 180 degrees and a transverse reference line 870 extending from 90 degrees to 270 degrees.

The set of dilution passages 812 terminate in a first group of slots 882 and a second group of slots 884, each disposed on a first line 816 and a second line 818. The first group of slots 882 can have a different formation with respect to the second group of slots 884. As a non-limiting example, each slot of the first group of slots 882 can include a cross-sectional area that is larger than or smaller than a cross-sectional area of each slot of the second group of slots 884. As a non-limiting example, each slot of the second group of slots 884 can include a second passage angle (e.g., the second passage angle (θ) of FIG. 9) while each slot of the first group of slots 882 do not.

The first group of slots 882 and the second group of slots 884 can each be continuously provided on a suitable portion of the first line 816 and the second line 818. As a non-limiting example, there can be two separate groups of the second group of slots 884 per the first line 816 and second line 818. As a non-limiting example, the second group of slots 884 can be provided along circumferentially distal ends of the first line 816 and second line 818. It will be appreciated that the seventh dilution passage arrangement 800 can include any number of two or more groups of slots.

The benefit of including the seventh dilution passage arrangement 800 having the first group of slots 882 and the second group of slots 884 is that the seventh dilution passage arrangement 800 allows for tuning of the flame shape and cooling/insulation efficiency of the seventh dilution passage arrangement 800. As a non-limiting example, the second group of slots 884 can be provided along circumferentially distal ends of the first line 816 and the second line 818 and include the second passage angle. The first group of slots 882 can be provided circumferentially between the second group of slots 884 and be inwardly, outwardly, or axial slots without a second passage angle. As such, the second group of slots 884 can be used to provide the hydrodynamic curtain of air that is in-line with or counter to the fuel air mixture, as described herein, while the first group of slots 882 can be used to compress or expand the flame.

Figure 16:
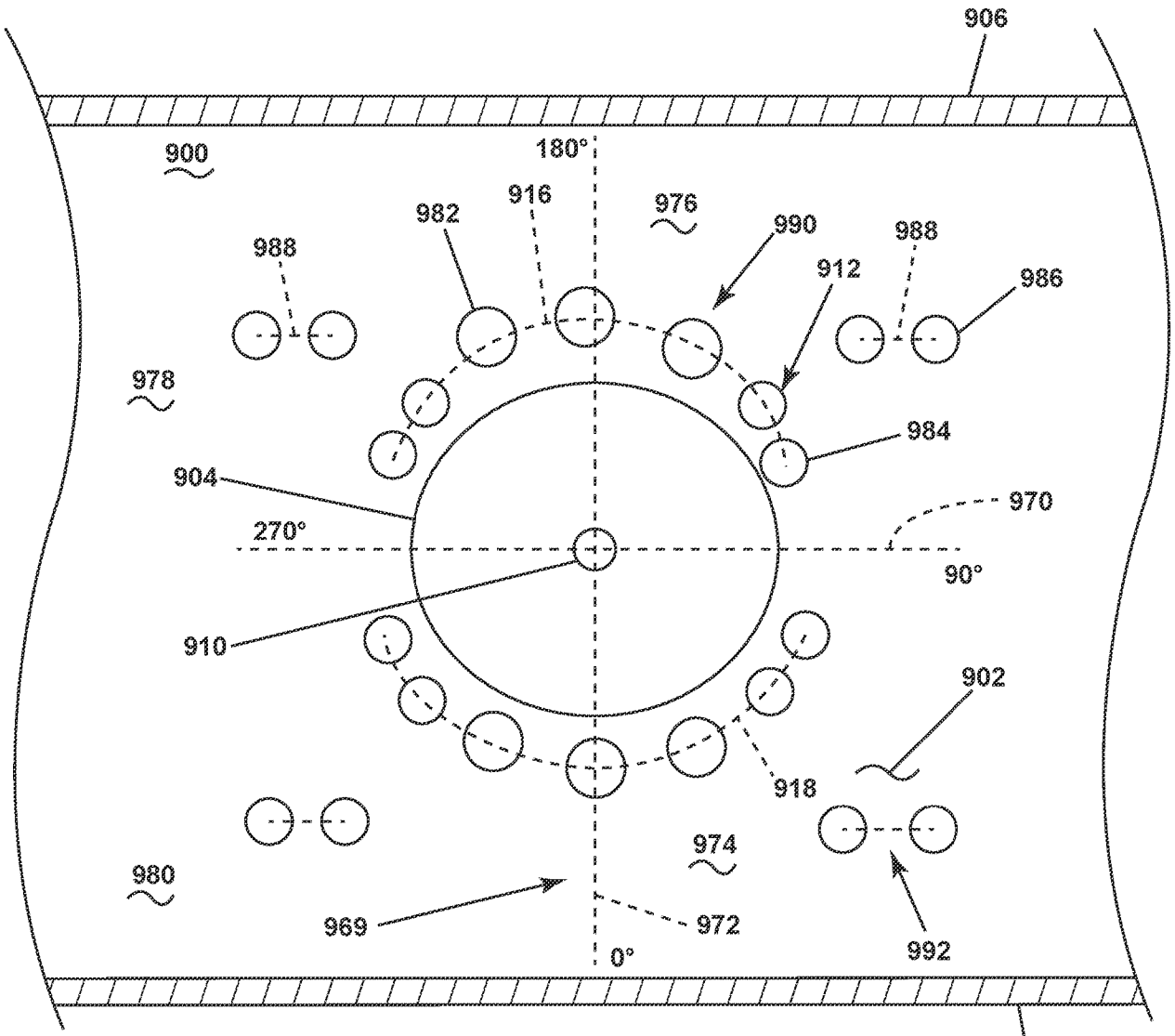
FIG. 16 is a schematic, transverse view of an eighth dilution passage arrangement suitable for use as the dilution passage arrangement of FIG. 4, the dilution passage arrangement including a plurality of slots having a first row of slots and a second row of slots.

FIG. 16 is a schematic, transverse view of an exemplary eighth dilution passage arrangement 900 suitable for use as the first dilution passage arrangement 200 of FIG. 4. The eighth dilution passage arrangement 900 is similar to the dilution passage arrangement 200, 300 (FIG. 10), 400 (FIG. 11), 500 (FIG. 12), 600 (FIG. 13), 700 (FIG. 14), 800 (FIG. 15), therefore, like parts will be identified by like numerals increased to the 900 series, with it being understood that the description of the dilution passage arrangement 200, 300, 400, 500, 600, 700, 800 applies to the eighth dilution passage arrangement 900, unless otherwise noted.

The eighth dilution passage arrangement 900 is provided on a dome wall 902 and surrounding a fuel cup 904 having a fuel cup centerline 910. The dome wall 902 extends radially between an outer liner 906 and an inner liner 908. A plurality of dilution passages 912 extend through the dome wall 902. The eighth dilution passage arrangement 900 is provided along a polar coordinate system 969 having a fuel cup reference line 972 extending from 0 degrees to 180 degrees and a transverse reference line 970 extending from 90 degrees to 270 degrees. The polar coordinate system 969 includes a first quadrant 974, a second quadrant 976, a third quadrant 978, and a fourth quadrant 980.

The eighth dilution passage arrangement 900, like the seventh dilution passage arrangement 800, can include the first group of slots 982 and the second group of slots 984 disposed on a first line 916 and a second line 918. The difference, however, is that the eighth dilution passage arrangement 900 further includes a third group of slots 986 provided radially outward, with respect to the fuel cup centerline 910, from the first group of slots 982 and the second group of slots 984. This, in turn, forms a first row of slots 990 having the first group of slots 982 and the second group of slots 984 following the first line 916 and the second line 918, and a second row of slots 992 having the third group of slots 986 and following a third line 988.

The third group of slots 986 can be uniform or non-uniform with the first group of slots 982 or the second group of slots 984. The third line 988 can extend linearly or non-linearly and be parallel to or non-parallel to the transverse reference line 970. The second row of slots 992 can include a total of four third groups of slots 986. As a non-limiting example, one third group of slots 986 can be provided in each of the first quadrant 974, the second quadrant 976, the third quadrant 978 and the fourth quadrant 980.

The benefit of having the first row of slots 990 and the second row of slots 992 is to further shape the flame (e.g., the flame 240 of FIG. 9) such that the flame does not escape through the curtain of compressed air generated by the first row of slots 990 and the second row of slots 992 and heat the outer liner (e.g., the outer liner 206 of FIG. 4), inner liner (e.g., the inner liner 208 of FIG. 4) or dome wall 902.

Benefits of the present disclosure include a combustor suitable for use with a hydrogen-containing fuel. As outlined previously, hydrogen-containing fuels have a higher flame temperature than traditional fuels (e.g., fuels not containing hydrogen). That is, hydrogen or a hydrogen mixed fuel typically has a wider flammable range and a faster burning velocity than traditional fuels such petroleum-based fuels, or petroleum and synthetic fuel blends. These high burn temperatures of hydrogen-containing fuel mean that additional insulation is needed between the ignited hydrogen-containing fuel and surrounding components of the gas turbine engine (e.g., the dome wall, the inner/outer liner, and other parts of the gas turbine engine). The combustor, as described herein, includes the plurality of slots that create a layer of insulation (e.g., the curtain of compressed air) between the ignited hydrogen-containing fuel and the dome wall, the inner liner, the outer liner, and any portions of the gas turbine engine outside of the dome wall, the inner liner and the outer liner. The curtain of compressed air is further used to shape the flame within the combustion chamber, which in turn results in an enhanced control of the flame shape profile. By shaping the flame the liner wall temperature, the dome wall temperature, the combustor exit temperature profile and pattern of the flame/gas exiting the combustor can be controlled. This control or shaping can further ensure that the combustion section or otherwise hot sections of the turbine engine do not fail or otherwise become ineffective by being overly heated, thus increasing the lifespan of the turbine engine. Further, the introduction of the dilution passage arrangements, as described herein, ensure an even, uniform, or otherwise desired flame propagation within the combustor.

Benefits associated with using hydrogen-containing fuel over conventional fuels include an eco-friendlier engine as the hydrogen-containing fuel, when combusted, generates less carbon pollutants than a combustor using conventional fuels. For example, a combustor including 100% hydrogen-containing fuel (e.g., the fuel is 100% $H_2$) would have zero carbon pollutants. The combustor, as described herein, can be used in instances where 100% hydrogen-containing fuel is used.

Further benefits associated with using hydrogen-containing fuel over conventional fuels include a gas turbine engine that can utilize less fuel due to higher heating vale of fuel to achieve same turbine inlet temperatures. For example, a conventional gas turbine engine using conventional fuels will require more fuel to produce the same amount of work or engine output as the present gas turbine engine using hydrogen-containing fuels. This, in turn, means that either less amount of fuel can be used to generate the same amount of engine output as a conventional gas turbine engine, or the same amount of fuel can be used to generate an excess of increased engine output when compared to the conventional gas turbine engine.

To the extent not already described, the different features and structures of the various embodiments can be used in combination, or in substitution with each other as desired. That one feature is not illustrated in all of the embodiments is not meant to be construed that it cannot be so illustrated, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to describe aspects of the disclosure described herein, including the best mode, and also to enable any person skilled in the art to practice aspects of the disclosure, including making and using any devices or systems and performing any incorporated methods. The patentable scope of aspects of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Further aspects are provided by the subject matter of the following clauses:

A combustor for a gas turbine engine, the combustor defining a combustor centerline and comprising a dome wall, an annular liner extending from the dome wall, a combustion chamber at least partially defined by the dome wall and the annular liner, a set of fuel cups circumferentially spaced along the dome wall relative to the combustor centerline, with each fuel cup having a fuel cup centerline, a set of dilution passages for each fuel cup of the set of fuel cups, with each dilution passage of the set of dilution passages having a passage centerline, and a plurality of slots spaced about a fuel cup in the set of fuel cups, with each slot of the plurality of slots defining a termination of at least one dilution passage of the set of dilution passages and including a center point defined as a location where the passage centerline of the at least one dilution passage intersects the slot, with the center points of the plurality of slots located on a polar coordinate system having a fuel cup reference line extending through the fuel cup centerline and defining a 0 degree to 180 degree reference line, with 0 degrees being radially closest to the combustor centerline, a transverse reference line defining a 90 degree to 270 degree reference line, a first quadrant extending between 0 degrees and 90 degrees, a second quadrant extending between 90 degrees and 180 degrees, a third quadrant extending between 180 degrees and 270 degrees, and a fourth quadrant extending between 270 degrees and 360 degrees, wherein opposing breaks are defined by slot-free arc segments between +/−75 degrees from the transverse reference line, and opposing slot-present arc segments are located between the slot-free arc segments, with the plurality of slots being located in the slot-present arc segments and not present in the slot-free arc segments.

A combustor defining a combustor centerline, the combustor comprising a dome wall, an annular liner extending from the dome wall, a combustion chamber at least partially defined by the dome wall and the annular liner, a set of fuel cups circumferentially spaced along the dome wall relative to the combustor centerline, with each fuel cup having a fuel cup centerline, a set of dilution passages for each fuel cup of the set of fuel cups, with each dilution passage of the set of dilution passages having a passage centerline, and a plurality of slots spaced about a fuel cup in the set of fuel cups, with each slot of the plurality of slots defining a termination of at least one dilution passage of the set of dilution passages and including a center point defined as a location where the passage centerline of the at least one dilution passage intersects the slot, with the center points of the plurality of slots located on a polar coordinate system having a fuel cup reference line extending through the fuel cup centerline and defining a 0 degree to 180 degree reference line, with 0 degrees being radially closest to the combustor centerline, a transverse reference line defining a 90 degree to 270 degree reference line, a first quadrant extending between 0 degrees and 90 degrees, a second quadrant extending between 90 degrees and 180 degrees, a third quadrant extending between 180 degrees and 270 degrees, and a fourth quadrant extending between 270 degrees and 360 degrees, wherein opposing breaks are defined by slot-free arc segments between +/−75 degrees from the transverse reference, and opposing slot-present arc segments are located between the slot-free arc segments, with the plurality of slots being located in the slot-present arc segments and not present in the slot-free arc segments.

The combustor of any preceding clause, wherein the passage centerline forms a first passage angle with respect to the fuel cup centerline, with the first passage angle being greater than or equal to −70 degrees and less than or equal to 70 degrees.

The combustor of any preceding clause, wherein the set of dilution passages includes a first dilution passage having a first passage angle and a second dilution passage having a first passage angle, non-equal to the first passage angle of the first dilution passage.

The combustor of any preceding clause, wherein each dilution passage includes a respective first passage angle that is non-equal to each of the other first passage angles.

The combustor of any preceding clause, wherein the plurality of slots includes a first row of slots provided along a first line and a second row of slots positioned radially outward from the first row of slots, and being provided along a second line, separate from the first line.

The combustor of any preceding clause, wherein the second line is linear.

The combustor of any preceding clause, the second line forms a 0 degree angle with respect to the transverse reference line.

The combustor of any preceding clause, wherein the second line forms an angle with respect to the transverse reference line having an absolute value greater than 0 degrees and less than or equal to 60 degrees.

The combustor of any preceding clause, wherein the first line is non-linear.

The combustor of any preceding clause, wherein the first passage angle of the plurality of slots provided on the first line are larger than the first passage angle of the plurality of slots provided on the second line.

The combustor of any preceding clause, wherein the plurality of slots extend between at least two adjacent quadrants.

The combustor of any preceding clause, wherein the plurality of slots are provided along a first line, and each slot of the plurality of slots on the first line is provided a radial distance from the fuel cup centerline, with the radial distance serially increasing from one circumferential end of the first line to another circumferential end of the first line.

The combustor of any preceding clause, wherein a first subset of the plurality of slots follow a curved line, and a second subset of the slots follow a linear line extending from a circumferential end of the curved line, with the linear line corresponding to at least one of the opposing breaks.

The combustor of any preceding clause, wherein the linear line forms an angle with respect to the transverse reference line, the angle having an absolute value of greater than or equal to 0 degrees and less than or equal to 70 degrees.

The combustor of any preceding clause, wherein the plurality of slots are non-symmetrical about the corresponding fuel cup reference line.

The combustor of any preceding clause, wherein the plurality of slots follow a first line and a second line, separate from the first line, with the first line and the second line being symmetrical or non-symmetrical about at least one of either the fuel cup reference line or the transverse reference line.

The combustor of any preceding clause, wherein the set of dilution passages form a dilution passage arrangement about each fuel cup of the set of fuel cups, with at least two dilution passage arrangements being different from each other.

The combustor of any preceding clause, wherein the plurality of slots follow a non-circular polygonal path that extends circumferentially about the fuel cup centerline.

The combustor of any preceding clause wherein the set of fuel cups receive a flow of fuel including a hydrogen-containing fuel.

The combustor of any preceding clause, wherein the center point of each slot of the plurality of slots is located a first radial height from the fuel cup centerline, each fuel cup of the set of fuel cups includes an outlet formed along the dome wall, with a radially outer surface of the outlet located a second radial height from the fuel cup centerline, and a ratio between the first radial height and the second radial height is greater than 1 and less than or equal to 3.

The combustor of any preceding clause, wherein each slot of the plurality of slots includes a slot width when viewed along a vertical plane perpendicular to the corresponding fuel cup centerline and intersecting a respective slot, each fuel cup of the set of fuel cups includes an outlet formed along the dome wall, the outlet having an outlet width, and a ratio between the slot width and the outlet width is greater than or equal to 0.03 and less than or equal to 0.5.

The combustor of any preceding clause, wherein a fuel/air mixture is fed to the combustion chamber, through the set of fuel cups, with a portion of the fuel/air mixture being fed through a corresponding fuel cup of the set of fuel cups at a fuel/air volumetric flow rate, and a compressed air is fed to the combustion chamber through the corresponding set of dilution passages at a compressed air volumetric flow rate, with a ratio between the fuel/air volumetric flow rate and the compressed air volumetric flow rate being greater than or equal to 0.2 and less than or equal to 4.

The combustor of any preceding clause, wherein each dilution passage of the plurality of dilution passages includes a total axial length between an inlet of the dilution passage and a respective slot, the respective slot includes a slot width when viewed along a vertical plane perpendicular to the corresponding fuel cup centerline and intersecting the respective slot, and with a ratio between the total axial length and the slot width being greater than or equal to 0.1 and less than or equal to 10.

What is claimed is:

1. A combustor for a gas turbine engine, the combustor defining a combustor centerline and comprising:

a dome wall;

an annular liner extending from the dome wall;

a combustion chamber at least partially defined by the dome wall and the annular liner;

at least one fuel cup having a fuel cup centerline;

a set of dilution passages, with each dilution passage of the set of dilution passages having a passage centerline;

a plurality of slots provided along the dome wall and being spaced about the at least one fuel cup, wherein:

each slot of the plurality of slots defines a termination of at least one dilution passage of the set of dilution passages;

each slot of the plurality of slots including a center point defined as a location where the passage centerline of the at least one dilution passage intersects the slot, each center points of the plurality of slots being located on a polar coordinate system having:

a fuel cup reference line extending through the fuel cup centerline and defining a 0 degree to 180 degree reference line, with 0 degrees being radially closest to the combustor centerline;

a transverse reference line defining a 90 degree to 270 degree reference line;

a first quadrant extending between 0 degrees and 90 degrees;

a second quadrant extending between 90 degrees and 180 degrees;

a third quadrant extending between 180 degrees and 270 degrees; and a fourth quadrant extending between 270 degrees and 360 degrees;

a break defining a slot-free arc segment extending circumferentially about the fuel cup that does not include the set of slots, the slot-free arc segment extending a total distance that is less than or equal to a range of 75 degrees to −75 degrees from the transverse reference line; and a slot-present arc segment extending circumferentially about the fuel cup and defining an area of the dome wall that includes the set of slots, with the slot-present arc segment being provided circumferentially adjacent the break;

wherein a first subset of the plurality of slots follow a curved line, and a second subset of the slots follow a linear line extending from a circumferential end of the curved line.

2. The combustor of claim 1, wherein each dilution passage of the set of dilution passages includes the passage centerline forming a first passage angle with respect to the fuel cup centerline, with the first passage angle being greater than or equal to −70 degrees and less than or equal to 70 degrees.

3. The combustor of claim 2, wherein the set of dilution passages includes a first dilution passage and a second dilution passage, each having a respective first passage angle, with the first passage angle of the first dilution passage being non-equal to the first passage angle of the second dilution passage.

4. The combustor of claim 2, wherein the plurality of slots includes a first row of slots provided along a first line and a second row of slots positioned radially outward from the first row of slots, and being provided along a second line, separate from the first line.

5. The combustor of claim 1, wherein the linear line forms an angle with respect to the transverse reference line having an absolute value greater than 0 degrees and less than or equal to 60 degrees.

6. The combustor of claim 1, wherein the linear line forms an angle with respect to the transverse reference line, the angle having an absolute value of greater than or equal to 0 degrees and less than or equal to 70 degrees.

7. The combustor of claim 1, wherein the plurality of slots are non-symmetrical about the fuel cup reference line.

8. The combustor of claim 1, wherein the at least one fuel cup receives a flow of fuel including a hydrogen-containing fuel.

9. The combustor of claim 1, wherein the linear line is a first linear line, the circumferential end of the curved line is a first circumferential end of the curved line, and the plurality of slots include a third subset of slots that follow a second linear line extending from a second circumferential end of the curved line.

10. The combustor of claim 1, wherein the linear line terminates at the break.

11. The combustor of claim 1, wherein the break is included within two breaks provided on radially opposite sides of the at least one fuel cup, with respect to the fuel cup centerline of the at least one fuel cup, each break of the two breaks defining a slot-free arc segment extending circumferentially about the at least one fuel cup that does not include the set of slots.

12. The combustor of claim 1, wherein each slot of the first subset of slots include a first cross-sectional area, and each slot of the second subset of slots include a second cross-sectional area, non-equal to the first cross-sectional area.

13. A combustor for a gas turbine engine, the combustor defining a combustor centerline and comprising:

a dome wall;

an annular liner extending from the dome wall;

a combustion chamber at least partially defined by the dome wall and the annular liner;

at least one fuel cup having a fuel cup centerline;

a set of dilution passages, with each dilution passage of the set of dilution passages having a passage centerline;

a plurality of slots provided along the dome wall and being spaced about the at least one fuel cup, wherein:

each slot of the plurality of slots defines a termination of at least one dilution passage of the set of dilution passages;

each slot of the plurality of slots including a center point defined as a location where the passage centerline of the at least one dilution passage intersects the slot, each center points of the plurality of slots being located on a polar coordinate system having:

a fuel cup reference line extending through the fuel cup centerline and defining a 0 degree to 180 degree reference line, with 0 degrees being radially closest to the combustor centerline;

a transverse reference line defining a 90 degree to 270 degree reference line; and four quadrants split by the fuel cup reference line and the transverse reference line, the four quadrants including a first quadrant circumferentially adjacent to a second quadrant; a break defining a slot-free arc segment extending circumferentially about the at least one fuel cup that does not include the set of slots; and a slot-present arc segment extending circumferentially about the at least one fuel cup and defining an area of the dome wall that includes the set of slots, with the slot-present arc segment being provided circumferentially adjacent the break;

wherein the plurality of slots include a subset of slots provided within at least the first quadrant and the second quadrant, the subset of slots including:

a first slot defined as a slot within a first adjacent quadrant circumferentially farthest from the second quadrant, the first slot being provided a first radial distance from the fuel cup centerline, the first radial distance being a minimum radial distance of the plurality of slots; and a second slot defined as a slot within a second adjacent quadrant circumferentially farthest from the first quadrant, the second slot being provided a second radial distance from the fuel cup centerline, the second radial distance being a maximum radial distance of the plurality of slots.

14. The combustor of claim 13, further comprising two slot-present arc segments provided on radially opposing sides of the at least one fuel cup, the two slot-present arc segments defining two radially opposing groups of slots of the plurality of slots, with the minimum radial distance of each group of slots of the plurality of slots being provided within a radially opposite quadrant from each other.

15. The combustor of claim 14, wherein the plurality of slots serially increase in radial distance from the fuel cup centerline from the first radial distance and to the second radial distance.

16. A combustor for a gas turbine engine, the combustor defining a combustor centerline and comprising:

a dome wall;

an annular liner extending from the dome wall;

a combustion chamber at least partially defined by the dome wall and the annular liner;

at least one fuel cup having a fuel cup centerline;

a set of dilution passages, with each dilution passage of the set of dilution passages having a passage centerline;

a plurality of slots provided along the dome wall and being spaced about the at least one fuel cup, wherein:

each slot of the plurality of slots defines a termination of at least one dilution passage of the set of dilution passages;

each slot of the plurality of slots including a center point defined as a location where the passage centerline of the at least one dilution passage intersects the slot, each center points of the plurality of slots being located on a polar coordinate system having:

a fuel cup reference line extending through the fuel cup centerline and defining a 0 degree to 180 degree reference line, with 0 degrees being radially closest to the combustor centerline;

a transverse reference line defining a 90 degree to 270 degree reference line; and four quadrants split by the fuel cup reference line and the transverse reference line, the four quadrants including a first quadrant circumferentially adjacent to a second quadrant; and a break defining a slot-free arc segment extending circumferentially about the fuel cup that does not include the set of slots, the slot-free arc segment extending a total distance that is less than or equal to a range of 75 degrees to −75 degrees from the transverse reference line;

wherein the plurality of slots include a first subset of slots provided within the first quadrant and a second subset of slots provided within the second quadrant, the first subset of slots and the second subset of slots extending along a respective portion of the break and each including at least three slots of the plurality of slots, with a first linear line and a second linear line extending through a center point of each slot of the first subset of slots and the second subset of slots, respectively, a projection of the first linear line and a projection of the second linear line intersecting the transverse reference line at an angle having an absolute value of greater than 0 degrees and less than or equal to 60 degrees.

17. The combustor of claim 16, wherein the first linear line and the second linear line are symmetric about the transverse reference line.

18. The combustor of claim 16, wherein the first linear line and the second linear line are parallel.

19. The combustor of claim 16, wherein the plurality of slots includes a third subset of slots, with a third line extending through each center point of the third subset of slots, the third line extending from the first linear line, the third line being linear or non-linear.

* * * * *